US008491183B2

(12) United States Patent
Koda et al.

(10) Patent No.: US 8,491,183 B2
(45) Date of Patent: Jul. 23, 2013

(54) DETENT ESCAPEMENT FOR TIMEPIECE AND MECHANICAL TIMEPIECE

(75) Inventors: Masayuki Koda, Chiba (JP); Hiroki Uchiyama, Chiba (JP); Matsuo Kishi, Chiba (JP); Miei Sato, Chiba (JP); Takashi Niwa, Chiba (JP)

(73) Assignee: Seiko Instruments Inc. (JP)

( * ) Notice: Subject to any disclaimer, the term of this patent is extended or adjusted under 35 U.S.C. 154(b) by 123 days.

(21) Appl. No.: 13/199,950

(22) Filed: Sep. 13, 2011

(65) Prior Publication Data

US 2012/0063273 A1 Mar. 15, 2012

(30) Foreign Application Priority Data

Sep. 14, 2010 (JP) ..... 2010-205380
Jul. 5, 2011 (JP) ..... 2011-149061

(51) Int. Cl.
*G04B 15/00* (2006.01)

(52) U.S. Cl.
USPC ..... 368/127; 368/131

(58) Field of Classification Search
USPC ..... 368/124, 127, 129–131, 169
See application file for complete search history.

(56) References Cited

U.S. PATENT DOCUMENTS

| | | | | |
|---|---|---|---|---|
| 179,019 | A * | 6/1876 | Hopkins | 368/131 |
| 1,091,261 | A * | 3/1914 | Walker | 368/131 |
| 6,942,378 | B2 * | 9/2005 | Hayek et al. | 368/127 |
| 7,040,803 | B2 * | 5/2006 | Hayek et al. | 368/127 |
| 7,192,180 | B2 * | 3/2007 | Hayek et al. | 368/127 |
| 7,458,717 | B2 * | 12/2008 | Baumberger et al. | 368/127 |
| 7,686,503 | B2 * | 3/2010 | Rochat et al. | 368/127 |
| 2008/0219103 | A1 | 9/2008 | Baumberger et al. | 368/131 |

OTHER PUBLICATIONS

George Daniel, "The Practical Watch Escapement", Premier Print Limited, 1994 (First Edition), pp. 39-47.

* cited by examiner

*Primary Examiner* — Vit W Miska
(74) *Attorney, Agent, or Firm* — Adams & Wilks

(57) ABSTRACT

A detent escapement for a timepiece capable of decreasing energy loss with respect to a free oscillation of a balance and improving a timekeeping accuracy is provided. In addition, a detent escapement of a timepiece capable of realizing miniaturization and suppressing variations in the accuracy of a finished product due to assembly errors is provided. A one-side actuating spring of a detent 7 is formed so that a maximum stress portion, which is generated at the time of operating due to the contact of an unlocking stone 4 when a balance 5 is return-rotated, is present to be perpendicular to a first straight line L1 which connects the center of the balance staff 9 and a fulcrum 23*a* of the blade 23, and to be the side opposite to the balance by a second straight line L2 which passes through the fulcrum 23*a*.

16 Claims, 17 Drawing Sheets

DETENT ESCAPEMENT FOR TIMEPIECE AND MECHANICAL TIMEPIECE

BACKGROUND OF THE INVENTION

1. Field of the Invention

The present invention relates to a detent escapement for a timepiece and a mechanical timepiece using the same.

2. Description of the Related Art

In the related art, a detent escapement, is known as an escapement for maintaining a daily rate of a mechanical timepiece. These kinds of escapement mechanisms are generally classified into a spring detent escapement and a pivoted detent escapement (for example, refer to pages 39 to 47, "The Practical Watch Escapement", Premier Print Limited, 1994 (First Edition), written by George Daniel.)

FIG. 11 is a perspective view showing an example of the spring detent escapement of the related art.

As shown in FIG. 11, the spring detent escapement 300 includes an escape wheel 301, a balance 303 that is freely oscillated about a balance staff 302 being a rotation axis, and a detent lever 304. The balance 303 includes an impulse jewel 305 that can contact a wheel tooth 301*a* of the escape wheel 301, and an unlocking stone 306 that can contact a one-side actuating spring 309 (passing spring) which is attached to the detent lever 304.

The detent lever 304 is fixed via a balance spring 307 which is installed at a base end thereof. The balance spring 307 supports the detent lever 304 so that the detent lever 304 approaches to and separates from the escape wheel 301, and biases the detent lever 304 to be returned to the original position. That is, the detent lever 304 is constituted being capable of approaching to and separating from the escape wheel 301 with the base end of the balance spring 307 as a fulcrum 304*a*.

In addition, a locking stone 308, which can contact the wheel tooth 301*a* of the escape wheel 301, is installed to the detent lever 304. In addition, the base end of the one-side actuating spring 309 is fixed to the base end side of the detent lever 304. The one-side actuating spring 309 is formed along the longitudinal direction of the detent lever 304 so that the tip of the one-side actuating spring 309 is slightly more protruded than that of the detent lever 304. That is, the one-side actuating spring 309 is formed so as to be along a straight line which passes through the balance staff 302 of the balance 303 and the fulcrum 304*a* of the detent lever 304. In addition, the tip of the one-side actuating spring 309 comes into contact with the unlocking stone 306 of the balance 303.

According to the above-described configuration, if the unlocking stone 306 is rotated toward the direction of an arrow CCW30 (a counterclockwise direction in FIG. 11) due to the fact that the balance 303 is freely oscillated, the detent lever 304 is pressed through the one-side actuating spring 309. Thereby, the locking stone 308, which comes into contact with the wheel tooth 301*a* of the escape wheel 301, is separated from the wheel tooth 301*a*, and the engagement between the escape wheel 301 and the detent lever 304 is released. Therefore, the escape wheel 301 is rotated by one tooth.

While the escape wheel 301 is rotated by one tooth, a bias force of the balance spring 307 acts on the detent lever 304, and the detent lever 304 is returned to the original position. Thereby, the locking stone 308 comes into contact with the wheel tooth 301*a* of the escape wheel 301 again. That is, the escape wheel 301 is engaged with the detent lever 304, and the rotation of the escape wheel 301 is stopped.

On the other hand, if the unlocking stone 306 reverses due to the free oscillation of the balance 303 and is rotated toward a direction of an arrow CW30 (a clockwise direction in FIG. 11), by the unlocking stone 306, the one-side actuating spring 309 is pressed toward the direction in which the one-side actuating spring 309 is separated from the detent lever 304. At this time, the detent lever 304 comes to be in the stopped state while the one-side actuating spring 309 is elastically deformed. After the unlocking stone 306 is separated from the one-side actuating spring 309, the one-side actuating spring 309 which is pressed to the unlocking stone 306 is returned to the original position by a restoration force of the one-side actuating spring 309 itself.

That is, when the unlocking stone 306 is rotated toward the direction of the arrow CCW30 and the detent lever 304 is pressed via the one-side actuating spring 309, the one-side actuating spring 309 does not perform any operation. On the other hand, if the unlocking stone 306 is rotated toward the direction of the arrow CW30, the one-side actuating spring 309 is elastically deformed and operated.

In addition, due the fact that the operation is repeatedly performed, a train wheel of the mechanical timepiece is driven at a constant speed.

FIG. 12 is a perspective view showing an example of the pivoted detent escapement of the related art. In addition, the same aspects as the spring detent escapement 300 of FIG. 11 are described with denoting the same reference numbers.

As shown in FIG. 12, the pivoted detent escapement 400 includes the escape wheel 301, a balance 403 which is freely oscillated about the balance staff 302, and a detent lever 404. Here, the difference between the pivoted detent escapement 400 and the spring detent escapement 300 is that the basing means for returning the detent lever to the original position are different to each other.

That is, the detent lever 404 of the pivoted detent escapement 400 is rotatably supported via the rotation axis 410, and therefore, the detent lever 404 can approach to and separate from the escape wheel 301. In addition, a balance spring 407 installed to the detent lever 404 is constituted by a coil spring so as to enclose a rotation axis 410, and biases the detent lever 404 to be returned to the original position.

In addition, in the detent lever 404, the base end of the one-side actuating spring 409 is fixed to a straight line P100 which is approximately perpendicular to the longitudinal direction of the detent lever 404 and passes through the rotation axis 410. The one-side actuating spring 409 is formed so as to be along the longitudinal direction of the detent lever 404, that is, the straight line which passes through the balance staff 302 of the balance 403 and the rotation axis 410 of the detent lever 404. The tip of the one-side actuating spring comes into contact with the unlocking stone 306 of the balance 403.

According to the configuration, due to the fact that the balance 403 is freely oscillated, if the unlocking stone 306 is rotated in the direction of an arrow CCW31 (a counterclockwise direction in FIG. 12) or in the direction of an arrow CW31 (a clockwise direction in FIG. 12), the one-side actuating spring 409 is operated or not operated at all according to the rotation. Thereby, the train wheel of the mechanical timepiece is driven at a constant speed.

However, in the above-described related art, when the one-side actuating springs 309 and 409 are operated, the unlocking stone 306 is rotated against the spring force. Therefore, energy loss with respect to the free oscillation of the balances 303 and 403 occurs.

Here, in the spring detent escapement 300, the base end of the one-side actuating spring 309 is fixed more to the tip side than the fulcrum 304*a* of the detent lever 304, that is, the balance 303 side. In addition, in the pivoted detent escapement 400, the base end of the one-side actuating spring 409 is fixed more to the slightly tip side than the rotation axis 410 of the detent lever 404, that is, to the balance 403 side.

In the configurations as described above, a portion of each one-side actuating spring 309 and 409 subjected to a maximum stress is present more at the tip sides than the fulcrum 304*a* of the detent lever 304 and the rotation axis 410 of the detent lever 404. Thereby, each one-side actuating spring 309 and 409 is difficult to bend, and the balances 303 and 403 are easily subjected to the influence of the spring force of the one-side actuating springs 309 and 409. Therefore, there are problems in that decreasing energy loss with respect to the free oscillation of the balances 303 and 403 is difficult and the timekeeping accuracy is deteriorated.

In addition, since each one-side actuating spring 309 and 409 is formed along the longitudinal direction of the respective detent levers 304 and 404, when the unlocking stone 306 is reversed (refer to arrows CW30 and CW31 in FIGS. 11 and 12) and the one-side actuating springs 309 and 409 are operated, the contact ranges between the unlocking stone 306 and the tips of the one-side actuating springs 309 and 409 become large. Thereby, there is a problem in that decreasing energy loss with respect to the free oscillation of balances 303 and 403 is more difficult.

The details will be described with reference to FIG. 13.

FIG. 13 is a behavior explanatory diagram of the one-side actuating spring. In addition, since the behaviors of one-side actuating springs 309 and 409 are approximately the same as each other, only the one-side actuating spring 309 which is attached to the detent lever 304 of the spring detent escapement 300 will be described.

As shown in FIG. 13, the one-side actuating spring 309 is formed along a straight line L100 which passes through the balance staff 302 of the balance 303 and the fulcrum 304*a* of the detent lever 304. Here, when the balance 303 is reversed (refer to an arrow CW32 in FIG. 13), the contact range between the unlocking stone 306 and the one-side actuating spring 309 becomes an angle θA in a rotational trajectory R1 of the unlocking stone 306.

On the other hand, for example, if the base end of the one-side actuating spring 309 is shifted to the right side in FIG. 13 so as to intersect with respect to the straight line L100 and the one-side actuating spring 309 is obliquely disposed (hereinafter, the one-side actuating spring is referred to as a "one-side actuating spring 309'"), the contact range between the unlocking stone 306 and the one-side actuating spring 309' becomes an angle θB in the rotational trajectory R1 of the unlocking stone 306.

That is, in order to set the contact range between the unlocking stone 306 and the one-side actuating spring 309 to be small, it is necessary to obliquely dispose the one-side actuating spring 309' with respect to the detent lever 304. However, with the above configuration, there is a problem in that entire detent escapement becomes large in the thickness direction.

In addition, in the spring detent escapement 300 or the pivoted detent escapement 400, since the detent levers 304 and 404 are large, the detent escapements become a so-called oversized head, and the centers of gravity are leaned forward. Thereby, the centers of gravity and the fulcrums of the one-side actuating springs 309 and 409 are deviated from each other, and loads applied to the balance springs 307 and 407 are varied due to the inclination of the detent escapement. Therefore, concern of deteriorating the timekeeping accuracy occurs.

In addition, the number of components constituting each escapement 300 and 400 is increased. Therefore, due to assembly errors, variations in the accuracy of the finished product, that is, variations of the center of gravity, the oscillation angle (amplitude), the daily rate, or the like, are increased.

SUMMARY OF THE INVENTION

Therefore, the invention is made in consideration of the above-described problems. An object of the invention is to provide a detent escapement for a timepiece capable of decreasing energy loss with respect to a free oscillation of a balance and improving a timekeeping accuracy.

In addition, another object of the invention is to provide a detent escapement of a timepiece capable of realizing miniaturization and suppressing variations in the accuracy of finished product due to assembly errors.

In order to accomplish the object of the invention, there is provided a detent escapement (for example, detent escapement 1) for a timepiece according to the invention including: an escape wheel (for example, escape wheel 2); a balance (for example, balance 5) that includes an impulse jewel (for example, impulse jewel 3) which can contact a wheel tooth (for example, wheel tooth 2*a*) of the escape wheel and an unlocking stone (for example, unlocking stone 4), and that freely oscillates about a balance staff (for example, balance staff 9); a blade (for example, blade 23) that includes a locking stone (for example, locking stone 6) which can contact the wheel tooth of the escape wheel, and that is supported being capable of approaching to and separating from the escape wheel; and a one-side actuating spring (for example, one-side actuating spring 24) that can contact the unlocking stone and be elastically deformed along the approaching and separating direction with respect to the blade, wherein the one-side actuating spring is formed so that a maximum stress portion (for example, maximum stress portion F1), which is generated at the time of operating due to the contact of the unlocking stone when the balance is return-rotated, is present to be perpendicular to the a first straight line (for example, first straight line L1) which connects the center of the balance staff and a fulcrum (for example, fulcrum 23*a*) of the blade, and to be the side opposite to the balance by a second straight line (for example, second straight line L2) which passes through the fulcrum.

In this case, the one-side actuating spring may be fixed to the blade.

According to the configuration, the distance between the maximum stress portion of the one-side actuating spring and the portion of the one-side actuating spring in which the unlocking stone contacts the one-side actuating spring can be sufficiently secured, and the one-side actuating spring can be easily bent. Thereby, energy loss with respect to the free oscillation of the balance is decreased, and the timekeeping accuracy can be improved.

In the detent escapement for the timepiece according to the invention, the one-side actuating spring may be formed so that the maximum stress portion is present at the side opposite to the escape wheel while interposing the blade.

According to the configuration, effects similar to those of the one-side actuating spring 309' which is obliquely disposed with respect to the detent lever 304 in FIG. 13 described above can be achieved. That is, when the one-side actuating spring is operated, the contact range between the one-side actuating spring and the unlocking stone can be set to be small by a simple configuration. Thereby, the energy loss with respect to the free oscillation of the balance can be more effectively decreased.

In the detent escapement for a timepiece according to the invention, the one-side actuating spring may include a curved portion (for example, circular arc portion 31, curved portion 131), in which the one-side actuating spring is curvedly formed toward the side opposite to the balance after the one-side actuating spring is extended in the direction which intersects the extension direction from the blade, and the one-side actuating spring is curvedly formed so as to be turned back toward the balance side.

According to the configuration, the distance between the maximum stress portion of the one-side actuating spring and the portion of the one-side actuating spring in which the unlocking stone contacts the one-side actuating spring can be sufficiently secured by a simple configuration, and the contact range between the one-side actuating spring and the unlocking stone can be set to be small while the miniaturization is improved.

In the detent escapement for a timepiece according to the invention, the detent escapement may include a balance spring (for example, balance spring 22) that biases the blade so as to be returned to the original position and a detent supporting portion (for example, detent fixing portion 21) for supporting the blade, and the curved portion of the one-side actuating spring may be formed so to enclose the periphery of the detent supporting portion.

According the configuration, the miniaturization is improved, and the distance between the maximum stress portion of the one-side actuating spring and the portion of the one-side actuating spring in which the unlocking stone contacts the one-side actuating spring can be sufficiently secured. The position of the maximum stress portion of the one-side actuating spring can be set to the side opposite to the escape wheel while interposing the blade, and the contact range between the one-side actuating spring and the unlocking stone can be set to be small.

Thereby, the energy loss with respect to the free oscillation of the balance can be more reliably decreased.

In the detent escapement for a timepiece according to the invention, the one-side actuating spring may be disposed so that a position of the center of gravity (for example, a position of the center of gravity J1) of a detent main body (for example, detent 7) which is constituted of the blade, the one-side actuating spring, and the balance spring is positioned at the fulcrum of the blade.

According to the configuration, the load'which is applied to the balance spring due to the inclination of the detent escapement can be prevented from varying. Thereby, the timekeeping accuracy can be improved.

In the detent escapement for a timepiece according to the invention, the blade, the one-side actuating spring, and the balance spring may be integrally molded.

According to the configuration, since the number of components can be decreased, the miniaturization is improved, and variations in the accuracy of the finished product due to the assembly errors can be suppressed.

In the detent escapement for a timepiece according to the invention, the blade, the one-side actuating spring, the balance spring, and the detent supporting portion may be integrally molded.

According to the configuration, a detent escapement can be provided, in which the number of components can be further decreased, the miniaturization can be achieved, and variations in the accuracy of the finished product due to the assembly errors can be further suppressed.

In the detent escapement for a timepiece according to the invention, the detent escapement may include a maximum stress position setting portion for setting the position of the maximum stress portion generated in the one-side actuating spring to a desired position.

According to the configuration, the position of the maximum stress portion can be set to a desired position regardless of the shape of the one-side actuating spring. Thereby, degree of freedom in the design of the one-side actuating spring can be improved.

In the detent escapement for a timepiece according to the invention, the maximum stress position setting portion may be installed in the curved portion of the one-side actuating spring.

In this case, the maximum stress position setting portion may be a thick portion which is formed in a portion of the curved portion.

In addition, the maximum stress position setting portion may be a thin portion which is formed in a portion of the curved portion.

According to the configuration, the position of the maximum stress portion can be easily changed by a simple configuration.

In the detent escapement for a time piece according to the invention, the maximum stress position setting portion may be an adjustment member which is installed so as to be separated from the one-side actuating spring, and the adjustment member may be disposed so as to come into contact with the one-side actuating spring when at least the adjustment member is displaced in the direction in which the one-side actuating spring is separated from the blade.

In this case, the adjustment member may be a movable pin which can displace along the curved portion of the one-side actuating spring.

According to this configuration, the position of the maximum stress portion can be changed without changing the shape of the one-side actuating spring.

A detent escapement for a timepiece according to the invention including: an escape wheel; a balance that includes an impulse jewel which can contact a wheel tooth of the escape wheel and an unlocking stone, and that freely oscillates about a balance staff; a blade that includes a locking stone which can contact the wheel tooth of the escape wheel, and that is supported being capable of approaching to and separating from the escape wheel; and a one-side actuating spring that can contact the unlocking stone and be elastically deformed along the approaching and separating direction with respect to the blade, wherein the one-side actuating spring may include a curved portion (for example, curved portion 232), in which the one-side actuating spring is curvedly formed toward the side opposite to the balance after the one-side actuating spring is extended in the direction which intersects the extension direction from the blade, and the one-side actuating spring is curvedly formed so as to be turned back toward the balance side.

According to the configuration, the one-side actuating spring is easily bent compared to the related art. Thereby, the energy loss with respect to the free oscillation of the balance is decreased, and the timekeeping accuracy can be improved.

A mechanical timepiece (for example, mechanical timepiece 100) according to the invention including: the detent escapement of the timepiece according to any one of claims 1 to 15; a mainspring (for example, mainspring 111) that constitutes a power source; and a gear train (for example, gear train 105) that is rotated by the rotation force generated when the mainspring is rewound, wherein the rotation of the gear train is controlled by the detent escapement for the timepiece.

According to the configuration, the mechanical timepiece having an improved timekeeping accuracy can be provided.

According to the invention, the distance between the maximum stress portion of the one-side actuating spring and the portion of the one-side actuating spring in which the unlocking stone contacts the one-side actuating spring can be sufficiently secured, and the one-side actuating spring can be easily bent. Thereby, the energy loss with respect to the free oscillation of the balance is decreased, and the timekeeping accuracy can be improved.

In addition, when the one-side actuating spring is operated, the contact range between the one-side actuating spring and the unlocking stone can be set to be small by a simple configuration. Thereby, the energy loss with respect to the free oscillation of the balance can be more effectively decreased.

Moreover, the distance between the maximum stress portion of the one-side actuating spring and the portion of the one-side actuating spring in which the unlocking stone contacts the one-side actuating spring can be sufficiently secured by a simple configuration, and the contact range between the one-side actuating spring and the unlocking stone can be set to be small while the miniaturization is improved.

In addition, since the number of components can be decreased, the miniaturization is improved, and variations in the accuracy of the finished product due to the assembly errors can be suppressed.

BRIEF DESCRIPTION OF THE DRAWINGS

FIGS. 14A and 14B show difference in shape of thick portions.

FIG. 16A is a plan view and FIG. 16B is an enlarged view of an A portion of FIG. 16A.

DETAILED DESCRIPTION OF THE PREFERRED EMBODIMENTS (First Embodiment)

(Mechanical Timepiece)

Next, a first embodiment of the invention will be described with reference to the drawings.

Figure 1:
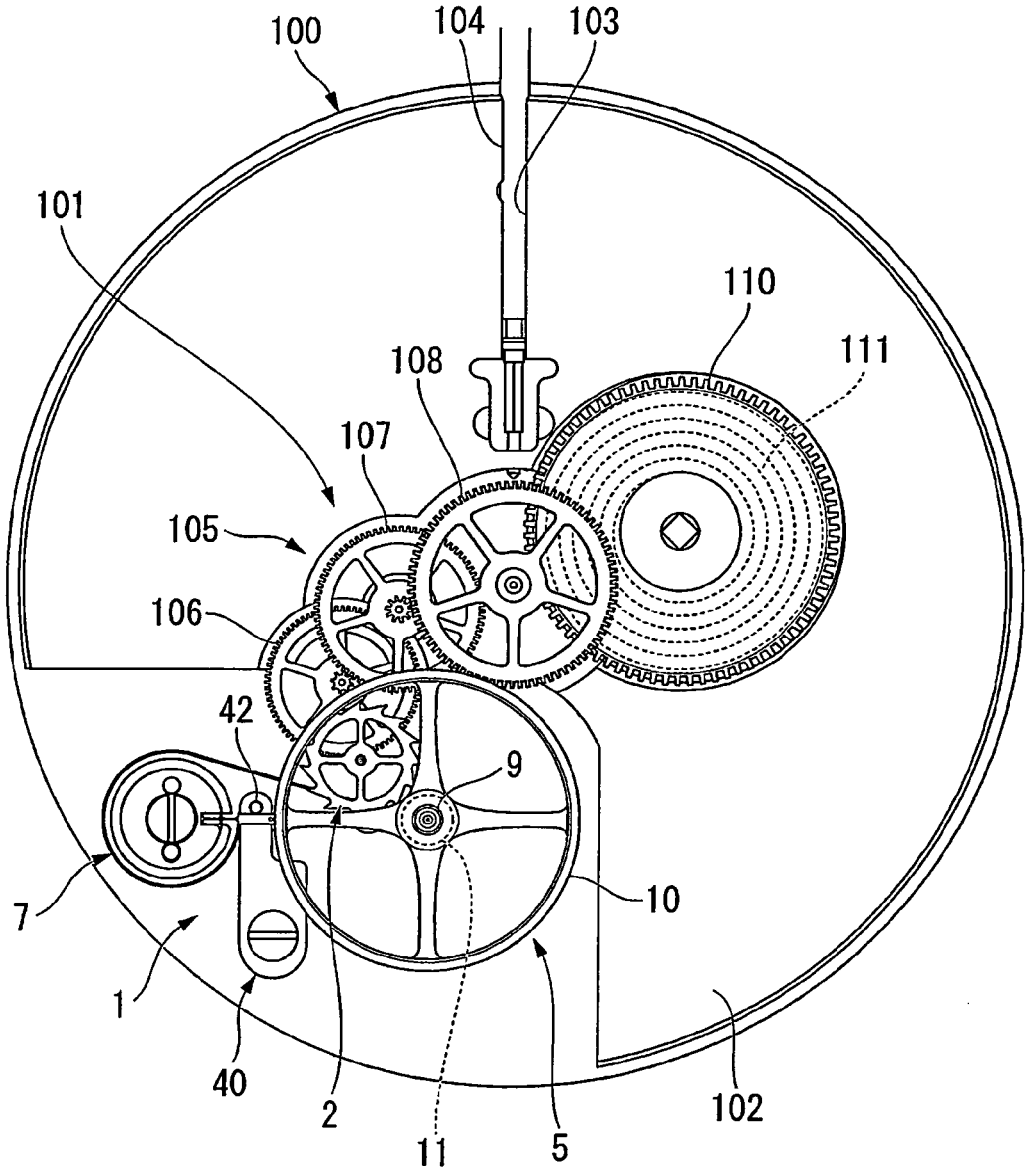
FIG. 1 is a plan view showing a movement of a mechanical timepiece according to a first embodiment of the invention from a rear cover side.

FIG. 1 is a plan view showing a movement of a mechanical timepiece from a rear cover side.

As shown in FIG. 1, the mechanical timepiece 100 includes a movement 101. The movement 101 includes a main plate 102 that constitutes a substrate of the movement 101. A winding stem guide hole 103 is formed at the main plate 102, and a winding stem 104 is rotatably assembled into the winding stem guide hole.

In addition, a switching mechanism (not shown), which includes a setting lever, a yoke, and a yoke holder, is disposed at the rear side of the movement 101 (the rear side of the paper in FIG. 1). The position in the axis direction of the winding stem 104 is determined by the switching mechanism.

On the other hand, a second wheel & pinion 106, a third wheel & pinion 107, a center wheel & pinion 108, and a movement barrel 110 constituting a gear train 105 are disposed in the front side of the movement 101 (the front side of the paper in FIG. 1). In addition, a detent escapement 1 is disposed so as to control the rotation of the gear train 105.

The movement barrel 110 includes a mainspring 111. If the winding stem 104 is rotated, a clutch wheel (not shown) is rotated, and the mainspring 111 is wound via a winding pinion, a crown wheel, and a ratchet wheel (none are shown). Moreover, by the rotation force which is generated when the mainspring 111 is rewound, the movement barrel 110 is rotated and the center wheel & pinion 108 is rotated.

The center wheel & pinion 108 includes a center pinion which is engaged with a movement wheel (not shown) of the movement barrel 110, and a center wheel (none are shown). If the center wheel & pinion 108 is rotated, a third wheel & pinion 107 is rotated.

The third wheel & pinion 107 includes a third pinion (not shown) which is engaged with a center wheel of the center wheel & pinion 108, and a third wheel (none are shown). If the third wheel & pinion 107 is rotated, the second wheel & pinion 106 is rotated.

The second wheel & pinion 106 includes a second pinion (not shown) which is engaged with the third wheel of the third wheel & pinion 107, and a second wheel (none are shown). The detent escapement 1 is driven due to the fact that the second wheel & pinion 106 is rotated. Due to the fact that the detent escapement 1 is driven, the second wheel & pinion 106 is controlled to be rotated one turn in one minute, and the center wheel & pinion 108 is controlled to be rotated one turn in one hour.

(Detent Escapement)

Figure 2:
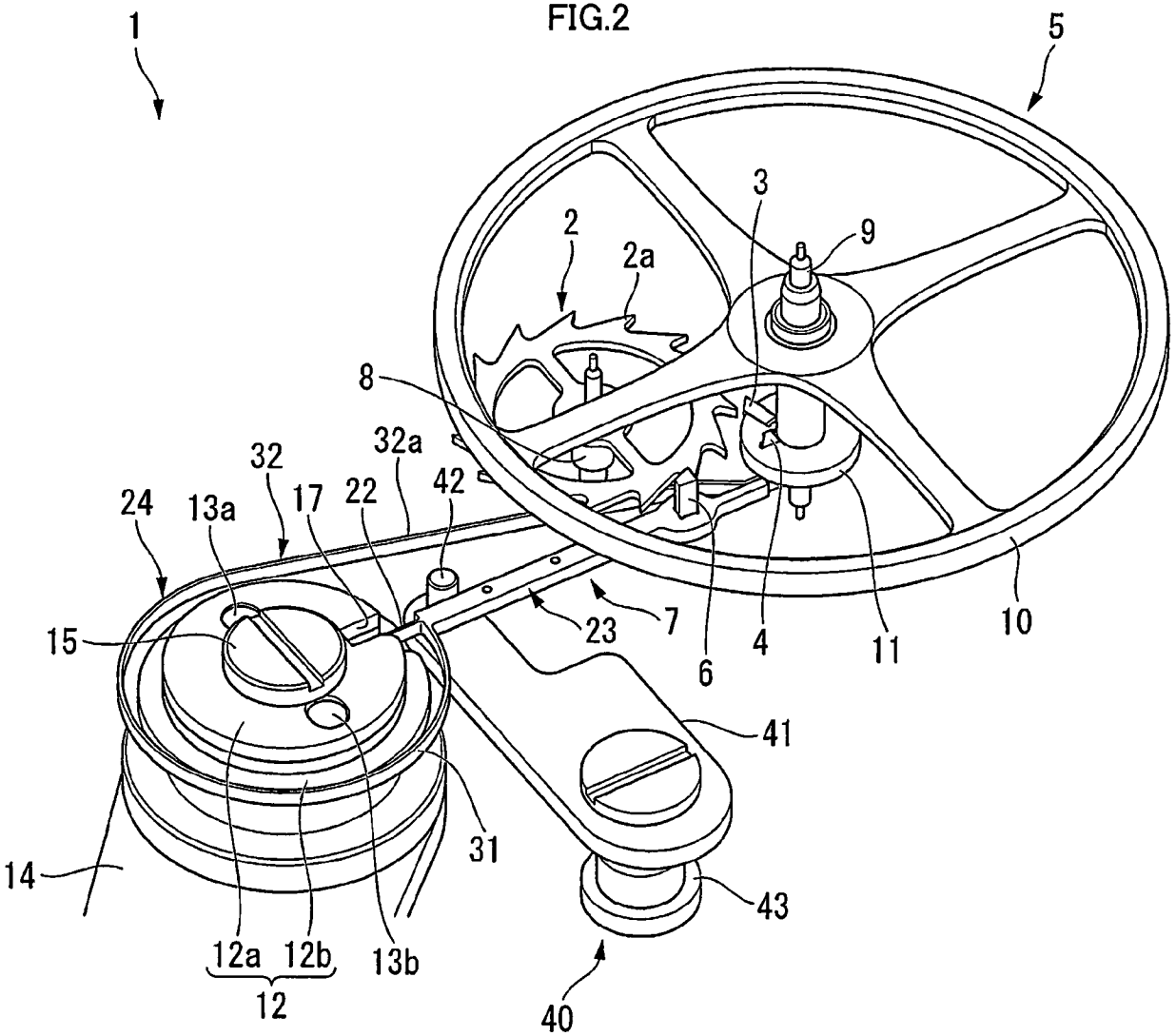
FIG. 2 is a perspective view showing a detent escapement according to the first embodiment of the invention.
Figure 3:
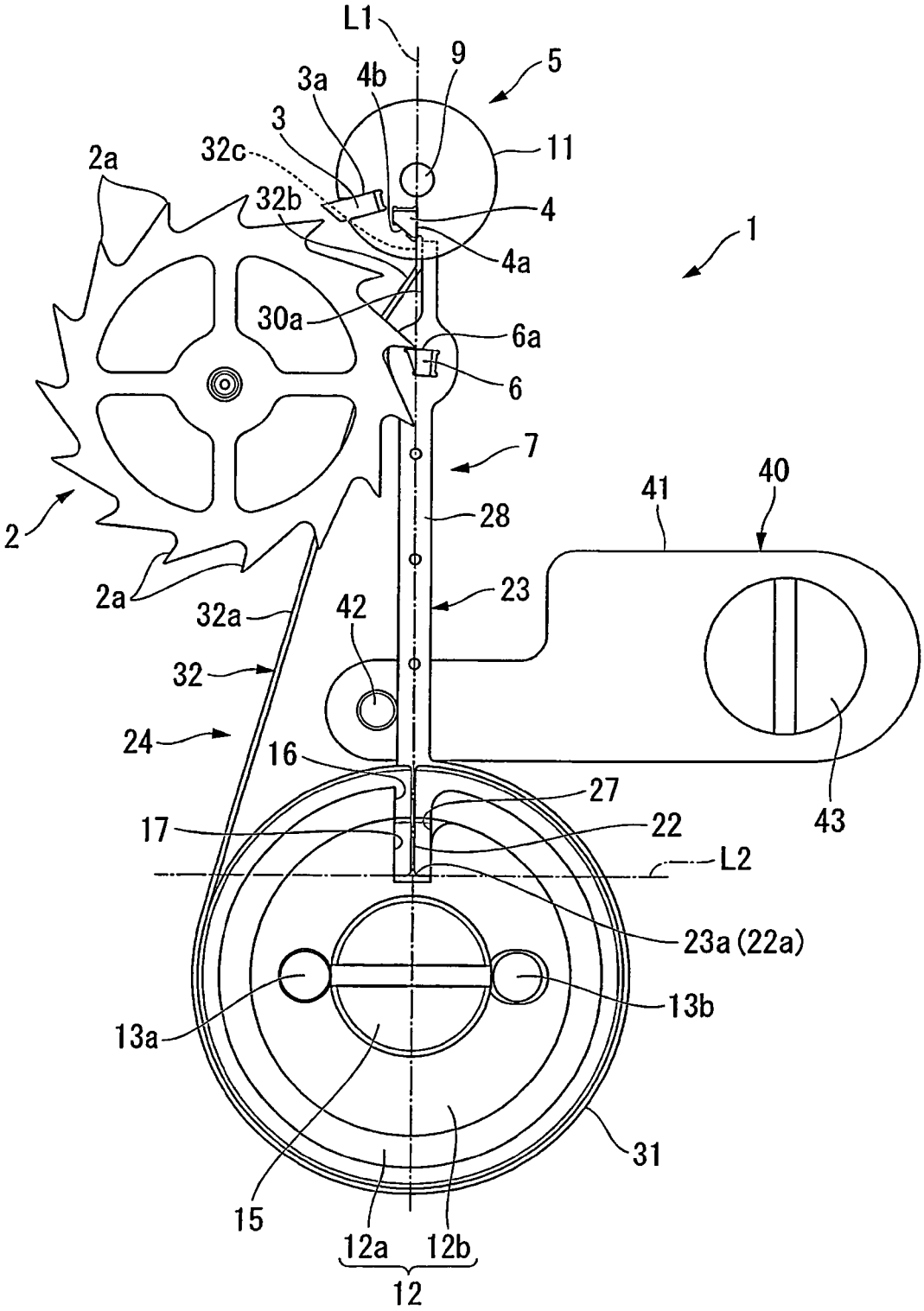
FIG. 3 is a plan view showing a detent escapement according to the first embodiment of the invention.

FIG. 2 is a perspective view showing the detent escapement, and FIG. 3 is a plan view showing the detent escapement.

As shown in FIGS. 2 and 3, the detent escapement 1 includes: an escape wheel 2 that is rotated due to the fact that the second wheel & pinion 106 is rotated; a detent 7 including a locking stone 6 that can contact a wheel tooth 2*a* of the escape wheel 2; a balance 5 including an impulse jewel 3 that can contact the wheel tooth 2*a* of the escape wheel 2 and an unlocking stone 4 that can contact the detent 7.

The escape wheel 2 includes an escape pinion 8 which is engaged with a second wheel (not shown), and the escape wheel is rotatably pivoted by the main plate 102 (refer to FIG. 1) and a train wheel bridge (not shown). That is, the upper axis portion of the escape pinion 8 is rotatably pivoted at the train wheel bridge, and the lower axis portion of the escape pinion 8 is rotatably pivoted at the main plate 102. In addition, the wheel tooth 2*a* of the escape wheel 2 is formed in a plurality (for example, 15 in the first embodiment) at the outer periphery of the escape wheel 2.

The balance 5 is freely oscillated about a balance staff 9 which is a rotation axis. In addition, other than the balance staff 9, the balance 5 includes a balance wheel 10 which is concentrically disposed with the balance staff 9, a roller table 11 having an approximately circular plate shape, and a hairspring (not shown). Moreover, the upper axis portion of the balance staff 9 is rotatably pivoted at the balance bridge (not shown), and the lower axis portion of the balance staff 9 is rotatably pivoted at the main plate 102. Therefore, the balance 5 is rotatably pivoted at the main plate 102 and the balance bridge.

Moreover, the impulse jewel 3 and the unlocking stone 4 are installed at the roller table 11. The cross-sectional shape of the impulse jewel 3 is formed in a rectangular shape so as to be extended along the radial direction of the roller table 11. In addition, in two surfaces which face in the lateral direction of the cross-section of the impulse jewel 3, a contact surface 3*a*, which comes into contact with the wheel tooth 2*a* of the escape wheel 2, is formed so as to be more protruded from the roller table 11 than the other surface.

The unlocking stone 4 can contact a one-side actuating spring 24 described hereinafter which is installed to the detent 7. The detent 7 is operated by the unlocking stone 4.

The detent 7 is fixed to the main plate 102 via a fixing washer 12. The fixing washer 12 is constituted of a large-diameter washer 12*a* and a small-diameter washer 12*b*. Moreover, the fixing washer interposes the detent 7 by each washer 12*a* and 12*b* in a state where the large-diameter washer 12*a* is disposed in the main plate 102 side (the downside in FIG. 2). Then, in this state, the detent 7 is fixed via a pair of fixing pins 13*a* and 13*b*.

In addition, the fixing washer 12 is connected to a rotating lever 14, which is installed the side opposite to the main plate 102 while interposing the main plate 102, via an adjustment bolt 15. The adjustment bolt 15 is installed so as to penetrate the center in the radial direction of the fixing washer 12. The rotating lever 14 adjusts the attachment angle of the detent 7, and is removed after the attachment angle of the detent 7 is adjusted.

(Detent)

Figure 4:
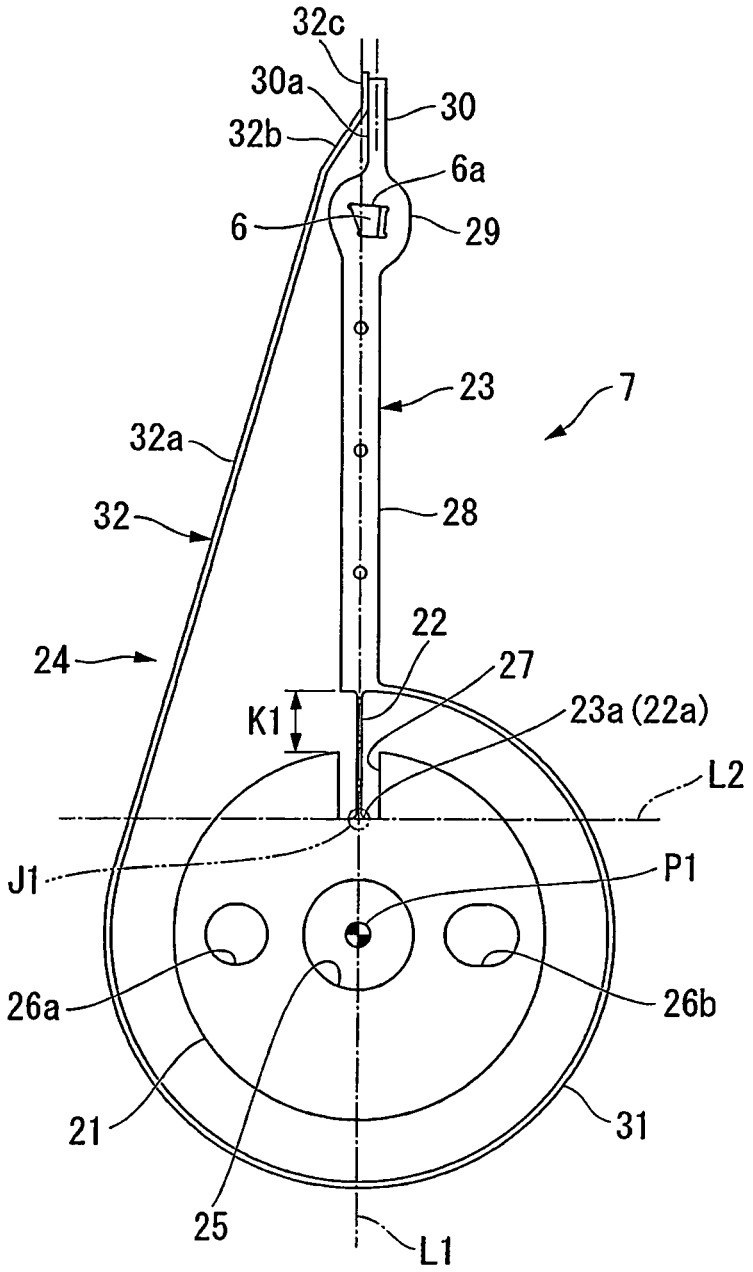
FIG. 4 is a plan view showing a detent according to the first embodiment of the invention.

FIG. 4 is a plan view showing the detent.

As shown in FIGS. 2 to 4, the detent 7 is integrally molded by a detent fixing portion 21 that is formed in a circular plate shape and interposed by the large-diameter washer 12*a* and the small-diameter washer 12*b* of the fixing washer 12, a blade 23 that is supported to the detent fixing portion 21 via a balance spring 22, and a one-side actuating spring 24 that can contact the unlocking stone 4.

Here, in methods for performing the integral molding, the detent 7 can be formed by an electroforming processing, a LIGA (Lithographie Galvanoformung Abformung) process adopting an optical method such as a photolithography, DRIE, or MIM.

The diameter of the detent fixing portion 21 is set so as to be approximately the same as the diameter of the small-diameter washer 12*b* which constitutes the fixing washer 12. A bolt insertion hole 25 into which the adjustment bolt 15 can be inserted is formed in the center in the radial direction of the detent fixing portion 21. Moreover, two pin insertion holes 26*a* and 26*b*, in which a pair of fixing pins 13*a* and 13*b* can be inserted, are formed in both sides which interposes the bolt insertion hole 25. One pin insertion hole 26*b* of two pin insertion holes 26*a* and 26*b* is formed in a long circular shape so as to allow for manufacturing errors of each part.

Moreover, a concave portion 27 is formed in the balance 5 side (the upside in FIG. 4) in the outer periphery of the detent fixing portion 21, and the balance spring 22 is erected in the concave portion 27. The balance spring 22 is formed in a plate shape along a first straight line L1 which connects the base end 22*a* of the balance spring 22 and the center (the center of the axis) of the balance staff 9 of the balance 5. For example, it is desirable that the balance spring 22 is formed of an elastic material such as nickel.

The blade 23 installed in the tip of the balance spring 22 is integrally molded by an arm 28 that is formed in a rectangular-parallelepiped shape along a first straight line L1, a locking stone attachment portion 29 that is disposed at the tip side of the arm 28 and has greater width than that of the arm 28, a tip portion 30 that is disposed at the tip portion side rather than the locking stone attachment portion 29 and formed in a rectangular-parallelepiped shape having a thinner width than that of the arm 28.

The locking stone 6 that can contact the wheel tooth 2*a* of the escape wheel 2 is installed in the locking stone attachment portion 29. The cross-sectional shape of the locking stone 6 is formed in an approximately trapezoidal shape so as to be gradually wide in the width along toward the tip portion 30 of the blade 23. In addition, the lower surface (the upper surface in FIGS. 3 and 4) of the locking stone 6 is set to a contact surface 6*a* which comes into contact with the wheel tooth 2*a* of the escape wheel 2.

The center of the tip portion 30 is disposed so as to be slightly offset toward the side opposite to the escape wheel 2 from the first straight line L1. The tip of the one-side actuating spring 24 abuts the abutting surface 30*a* of the escape wheel 2 side of the offset tip portion 30.

Similarly to the balance spring 22, for example, it is desirable that the one-side actuating spring 24 is also formed of an elastic material such as nickel.

The one-side actuating spring 24 is formed in an approximate 6-shape form in plan view, and includes a circular arc portion 31 that is extended from the base portion of the blade 23, that is, the base portion of the arm 28, and a straight line portion 32 that is extended from the tip of the circular arc portion 31 toward the tip portion 30 of the blade 23. In addition, the straight line portion 32 is elastically deformed along the approaching and separating direction with respect to the blade 23.

The circular arc portion 31 is extended from the base end of the arm 28 toward the side (the right side in FIGS. 3 and 4) opposite to the escape wheel 2 and along the direction which is approximately perpendicular to the first straight line L1. Thereafter, the circular arc portion 31 is formed in a circular arc shape so as to enclose about ¾ of the periphery of the detent fixing portion 21. That is, after the circular arc portion 31 is extended from the base end of the arm 28 toward the side opposite to the balance 5 once, the circular arc portion 31 is formed in a circular arc shape so as to turn back toward the balance 5 side. The center of a curvature radius of the circular arc portion 31 approximately coincides with the center of the detent fixing portion 21, that is, a center 21 of the bolt insertion hole 25 which is formed in the detent fixing portion 21.

On the other hand, the straight line portion 32 includes: a gently inclined portion 32*a* that is extended so as to be gently inclined with respect to the first straight line L1 from the tip of the circular arc portion 31; a steeply inclined portion 32*b* that is extend more steeply than the gently inclined portion 32*a* with respect to the first straight line L1 from the tip of the gently inclined portion 32*a*, in which the tip of the steeply inclined portion abuts the tip portion 30; and a tongue 32*c* that is extended along the tip portion 30 from the steeply inclined portion 32*b*.

The gently inclined portion 32*a* is extended from the tip of the circular arc portion 31 to a position corresponding to the locking stone attachment portion 29. That is, the straight line portion 32 comes to be in a state where the straight line portion is extended and formed from the tip of the circular arc portion 31 toward the tip portion 30 of the blade 23 so as to avoid the interference between the straight line portion 32 and the locking stone attachment portion 29 of the blade 23.

In addition, the tip of the tongue 32*c* is extended and formed so as to be slightly protruded from the tip portion 30 of the blade 23. The unlocking stone 4 of the balance 5 comes into contact with the region of the tongue 32*c* which is protruded from the tip portion 30.

Here, the center P1 of the bolt insertion hole 25 of the detent fixing portion 21 also is positioned in the first straight line L1, and the center P1, the balance spring 22, the blade 23, and the balance staff 9 are installed in the same straight line. The blade 23 of the detent 7 constituted as described above has the base end 22*a* of the balance spring 22 as a fulcrum 23*a*, and the blade 23 can approach to and separate from the escape wheel 2 about the fulcrum 23*a*. That is, due to the fact that the balance spring 22 is elastically deformed so that the base end 22*a* is the center, the blade 23 is displaced along the approaching and separating direction with respect to the escape wheel 2.

The balance spring 22 biases the blade 23 so as to be returned to the original position. More specifically, as the state shown in FIGS. 3 and 4, the balance spring 22 biases the blade 23 to be returned the position in which the longitudinal direction of the arm 28 of the blade 23 is on the first straight line L1. On the other hand, the spring force of the one-side actuating spring 24 is set to the degree such that the tongue 32*c* of the one-side actuating spring 24 can always abut the tip portion 30 of the blade 23.

In addition, since the balance spring 22 is formed in the concave portion 27 of the detent fixing portion 21, the separation distance K1 between the detent fixing portion 21 and the blade 23 can be secured with a sufficient length without being greatly set. Thereby, the balance spring 22 is constituted so that the blade 23 is sufficiently displaced along the approaching and separating direction of the escape wheel 2.

Here, the width of the concave portion 27 is set so that the displacement of the blade 23 along the approaching and separating direction is allowed with respect to the escape wheel 2. In addition, concave portions 16 and 17 each are formed at the region corresponding to the concave portion 27 of the detent fixing portion 21 in the large-diameter washer 12*a* and the small-diameter washer 12*b* that interpose the detent fixing portion 21. Thereby, even in the state where the detent 7 is fixed by each washer 12*a* and 12*b*, the blade 23 can be sufficiently displaced along the approaching and separating direction of the escape wheel 2.

In addition, since the one-side actuating spring 24 is constituted of the circular arc portion 31 and the straight line portion 32 and formed in an approximate 6-shape form in plan view, the position J1 of the center of gravity of entire detent 7 approximately coincides with the fulcrum 23*a* of the blade 23.

In the unlocking stone 4 that can contact the tongue 32*c* of the one-side actuating spring 24, the contact surface 4*a* of the unlocking stone 4, which comes into contact with the surface of the tongue 32*c* of the side opposite to the side of the tip portion 30, is formed so as to be along the tongue 32*c*. On the other hand, an inclined surface 4*b* is formed by chamfering at the side opposite to the contact surface 4*a* of the unlocking stone 4. Thereby, the cross-sectional shape of the unlocking stone 4 is like a trapezoid, which is tapered to go toward the outside in the radial direction of the roller table 11. In addition, the unlocking stone 4 is disposed so that the trajectory of the tip of the unlocking stone 4 becomes a position which cannot contact the blade 23 and a position which can contact the tongue 32*c* of the one-side actuating spring 24 at the time of the free oscillation of the balance 5.

Due the fact that the unlocking stone 4 or the detent 7 is constituted in this way, the blade 23 can approach to or separate from the escape wheel 2 according to the free oscillation of the balance 5 (the details will be described hereinafter).

Here, a stopper 40, which regulates the displacement toward the direction approaching to the escape wheel 2 of the blade 23, is installed in the main plate 102. The stopper 40 includes a stopper arm 41 and a stopper pin 42 which is erected in the tip of the stopper arm 41. In addition, the base end side of the stopper arm 41 is fixed to the main plate 102 via a fixing pin 43.

The stopper pin 42 abuts the arm 28 of the blade 23 from the escape wheel 2 side. Thereby, the displacement toward the direction approaching to the escape wheel 2 of the blade 23 is regulated.

Moreover, the stopper arm 41 is installed so as to be rotated about the fixing pin 43, and therefore, the position of the stopper pin 42 can be adjusted. Due to the fact that the position of the stopper pin 42 is adjusted, the movement regulating position of the blade 23 is set to the position in which the locking stone 6 can contact the wheel tooth 2*a* of the escape wheel 2 and the longitudinal direction of the arm 28 becomes the first straight line L1.

(Operation of Detent Escapement)

Next, with reference to FIG. 3 and FIGS. 5 to 7, operation of the detent escapement 1 will be described.

Figure 5:
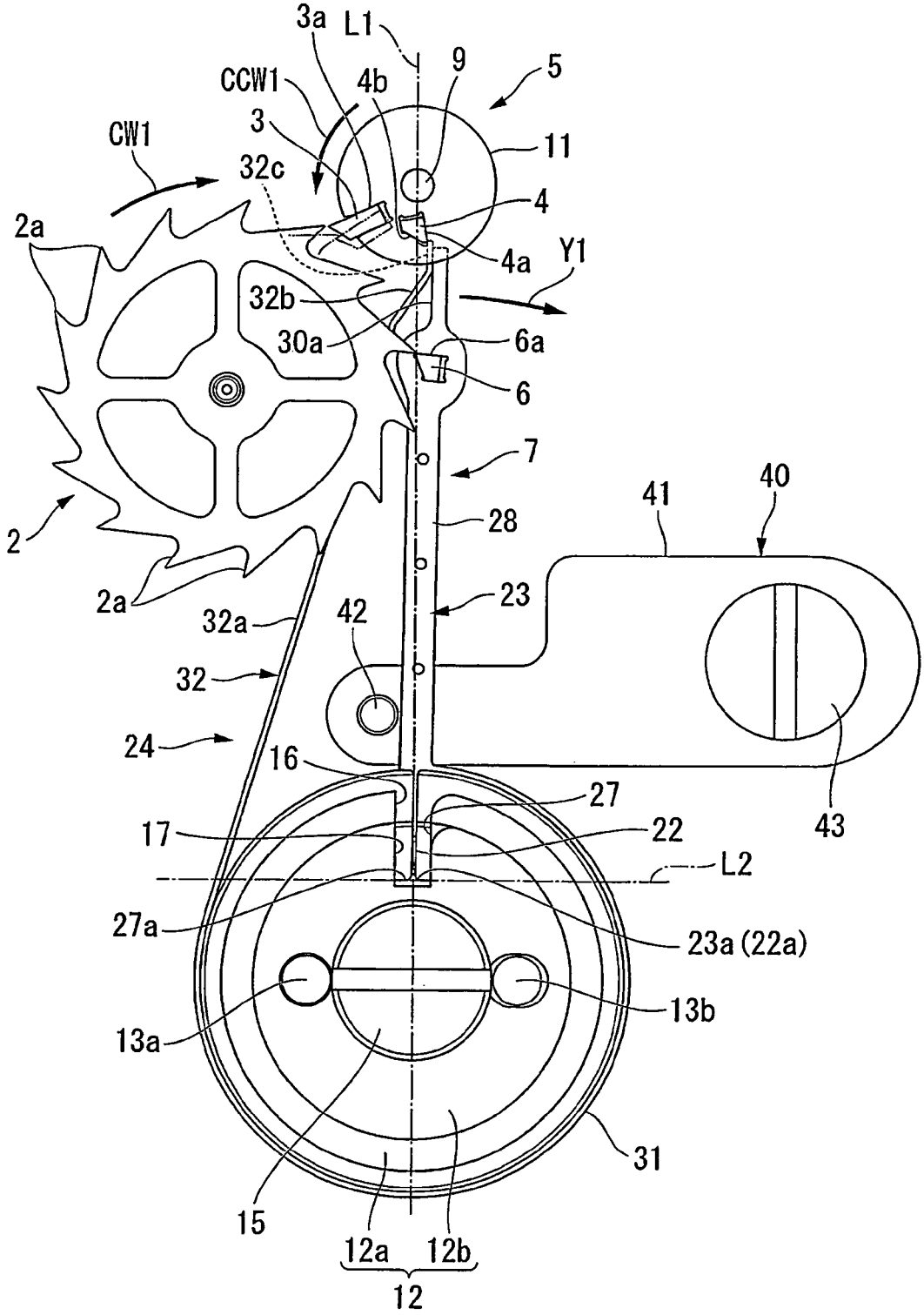
FIG. 5 is an explanatory diagram of operation of the detent escapement according to the first embodiment of the invention.
Figure 6:
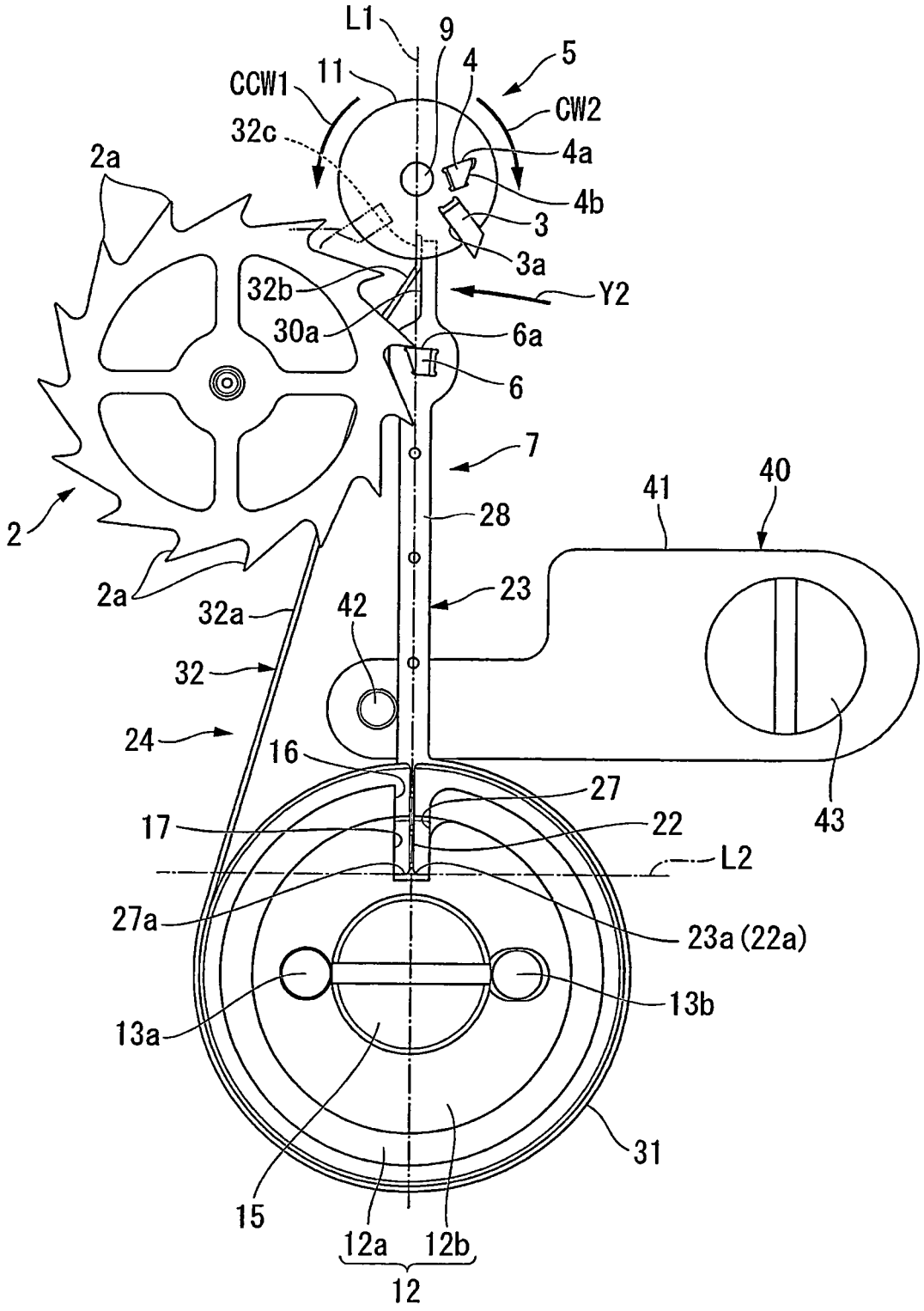
FIG. 6 is an explanatory diagram of operation of the detent escapement according to the first embodiment of the invention.
Figure 7:
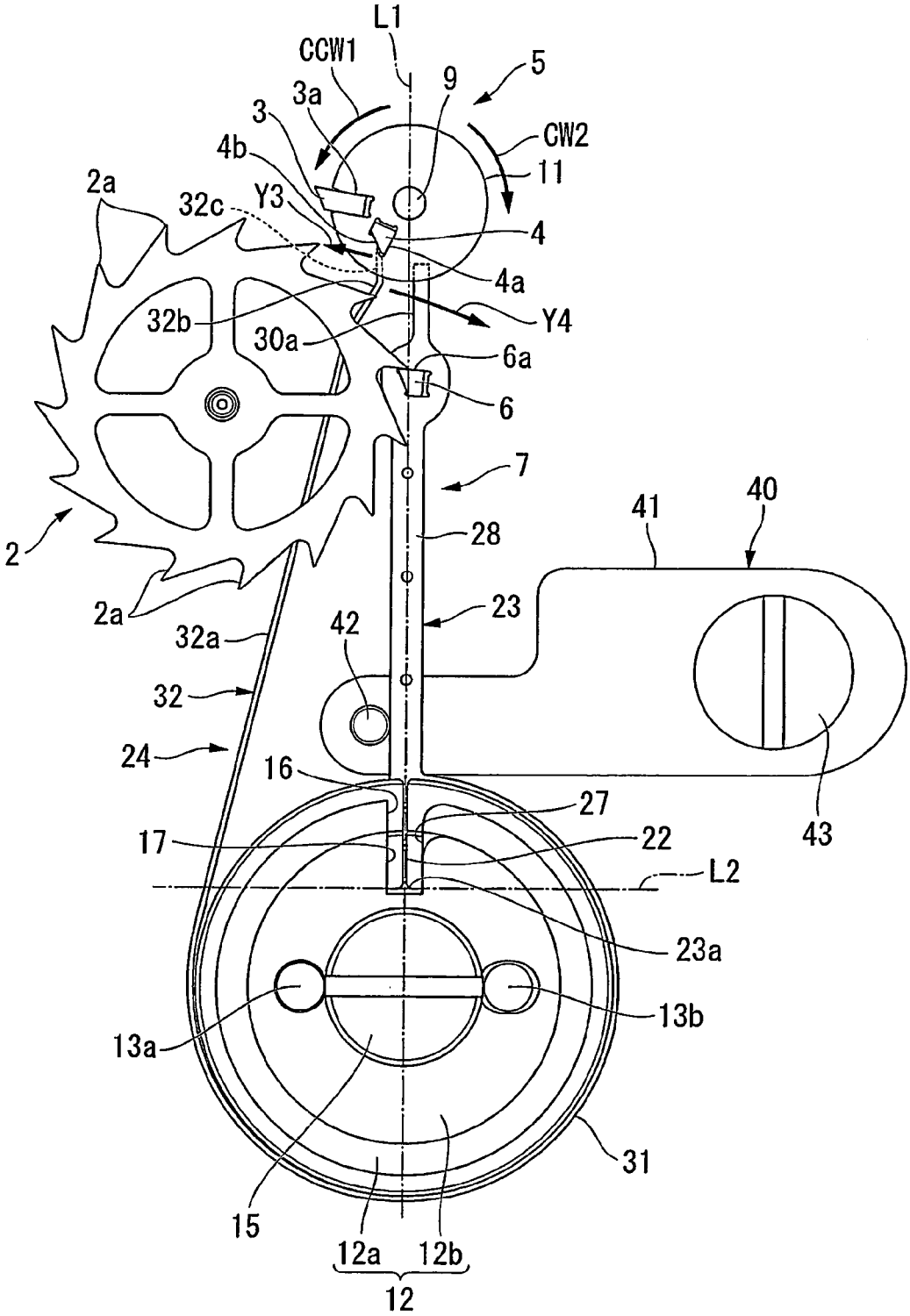
FIG. 7 is an explanatory diagram of operation of the detent escapement according to the first embodiment of the invention.

FIGS. 5 to 7 are explanatory diagrams of operation of the detent escapement.

As shown in FIG. 3, in a state where the blade 23 of the detent 7 is present at the position along the first straight line L1, the wheel tooth 2*a* of the escape wheel 2 comes into contact with the contact surface 6*a* of the locking stone 6 which is installed at the blade 23, and the escape wheel 2 and the locking stone 6 are engaged with each other.

Here, the escape wheel 2 is subjected to the rotation force from the gear train 105. However, in the state where the escape wheel 2 is engaged with the locking stone 6, the escape wheel 2 is stopped.

From the above state, as shown in FIG. 5, due to the fact that the balance 5 is freely oscillated, if the roller table is rotated in a direction of an arrow CCW1 (a counterclockwise direction in FIG. 5), the contact surface 4*a* of the unlocking stone 4 installed in the roller table 11 abuts the tip of the tongue 32*c* of the one-side actuating spring 24 constituting the detent 7. In addition, the blade 23 is pressed via the tongue 32*c* by the unlocking stone 4, and is displaced toward the direction (refer to an arrow Y1 in FIG. 5) in which the blade 23 is separated from the escape wheel 2.

At this time, due to the fact that the balance spring 22 is elastically deformed so as to be bent, the blade 23 is displaced. However, with respect to this, the one-side actuating spring 24 is barely elastically deformed. That is, in the case where the tongue 32*c* is slightly displaced toward the direction (the direction of the arrow Y1 in FIG. 5) in which tongue 32*c* is separated from the escape wheel 2, the one-side actuating spring 24 is formed in an approximate 6-shape form in plan view. In addition, since the straight line portion 32 is slightly displaced only in the direction in which the circular arc portion 31 is wound, the one-side actuating spring 24 is barely elastically deformed.

Due to the fact that the blade 23 is displaced toward the direction in which the blade 23 is separated from the escape wheel 2, the locking stone 6 installed in the blade 23 is separated from the wheel tooth 2*a* of the escape wheel 2, and engagement between the escape wheel 2 and the locking stone 6 is released. Thereby, the escape wheel 2 is rotated in a direction of an arrow CW1 (a clockwise direction in FIG. 5).

In addition, due to the fact the roller table 11 is rotated in the direction of the arrow CCW1, at approximately the same time that the escape wheel 2 starts the rotation in the direction of the arrow CW1, the contact surface 3*a* of the impulse jewel 3 comes into contact with the wheel tooth 2*a* of the escape wheel 2 (refer to a two dotted line in FIG. 5). Moreover, the rotation force of the escape wheel 2 is transmitted to the balance 5 via the impulse jewel 3. At this time, the rotation force in the direction of the arrow CCW 1 is applied to the balance 5.

As shown in FIG. 6, if the roller table 11 is rotated by a predetermined angle in a direction of an arrow CCW1 (a counterclockwise direction in FIG. 6), the unlocking stone 4 is separated from the tip of the tongue 32*c* of the one-side actuating spring 24. Then, by the restoration force of the balance spring 22, the blade 23 is displaced toward the direction (refer to an arrow Y2 in FIG. 6) which approaches to the escape wheel 2. At this time, the displacement of the blade 23 is regulated by the stopper 40, and the blade 23 is returned to the original position.

Due to the fact that the blade 23 is returned to the original position, the wheel tooth 2*a* of the rotating escape wheel 2 abuts the contact surface 6*a* of the locking stone 6, and the escape wheel 2 and the locking stone 6 are again engaged with each other. Thereby, the rotation of the escape wheel 2 is stopped. Here, during from the time when the engagement between the escape wheel 2 and the locking stone 6 is released to the time when the escape wheel 2 and the locking stone 6 are again engaged with each other, the escape wheel 2 is rotated by only one tooth.

On the other hand, the balance 5 to which the rotation force toward the direction of the arrow CCW1 is applied by the escape wheel 2 can wind up the hairspring which is installed in the balance 5. Moreover, if the hairspring is wound by a predetermined amount, the restoration force of the hairspring and the rotation force of the balance 5 are reversed, and the rotation direction of the roller table 11 is changed to the direction of the arrow CW2 (a clockwise direction in FIG. 6).

As shown in FIG. 7, if the roller table 11 is rotated in the direction of the arrow CW2, the inclined surface 4*b* of the unlocking stone 4 comes into contact with the tip of the tongue 32*c* of the one-side actuating spring 24. In addition, due to the fact that the roller table 11 is further rotated, the tongue 32*c* of the one-side actuating spring 24 is pressed toward the direction in which the tongue 32*c* is separated from the blade 23, that is, the direction toward the escape wheel 2 (refer to an arrow Y3). Then, the one-side actuating spring 24 is elastically deformed so that the straight line portion 32 is pressed and expanded.

Here, with reference to FIG. 8, the distribution of stress generated due to the fact the one-side actuating spring 24 is elastically deformed will be described.

Figure 8:
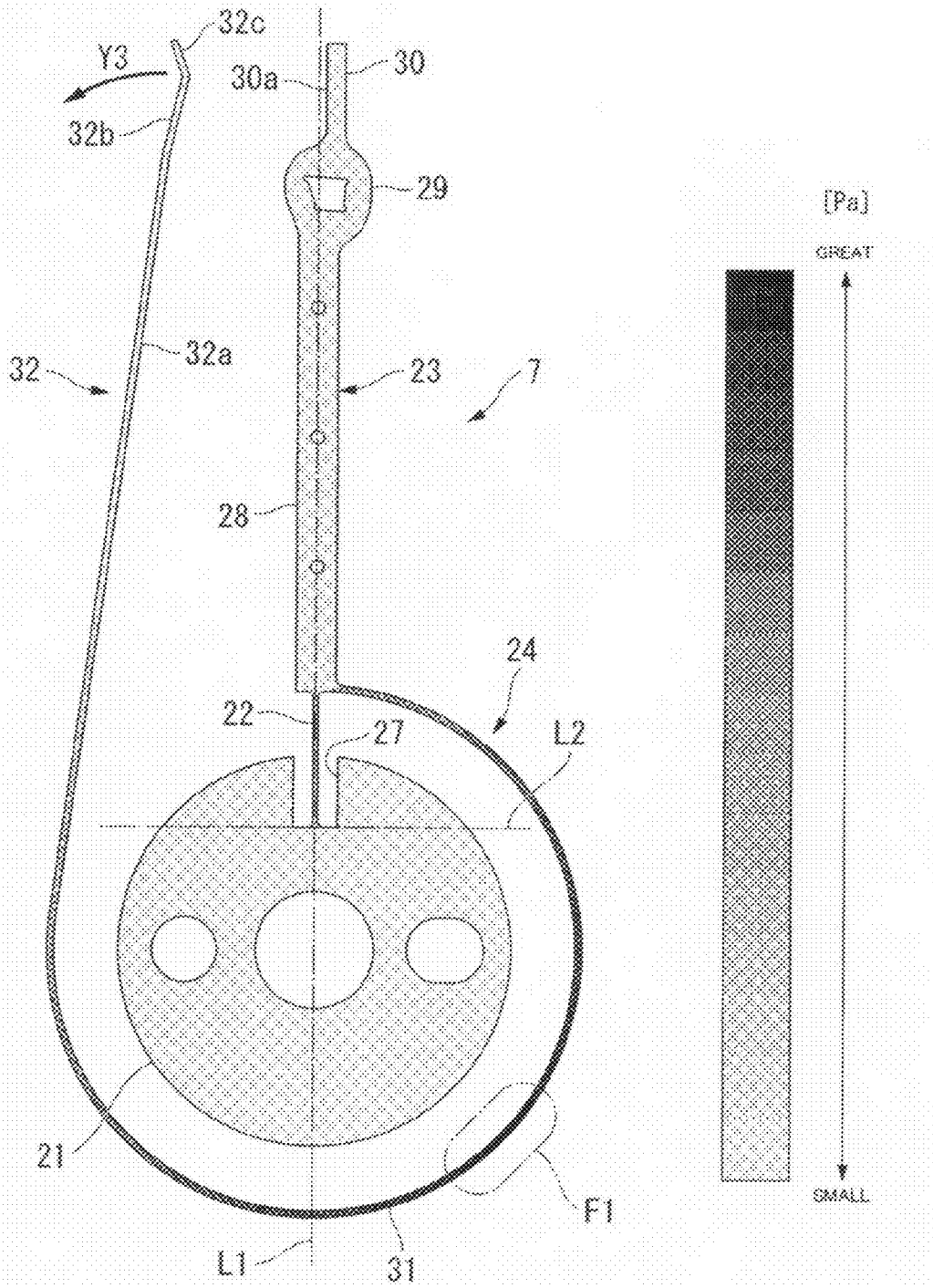
FIG. 8 is a stress distribution diagram showing a state where a one-side actuating spring of a detent according to the first embodiment of the invention is elastically deformed.

FIG. 8 is a stress distribution diagram showing the state where the one-side actuating spring of the detent is elastically deformed.

As shown in FIG. 8, when the straight portion 32 of the one-side actuating spring 24 is expanded toward the direction (refer to the arrow Y3 in FIG. 8) in which the straight portion 32 is separated from the blade 23, a maximum stress portion F1 to which the greatest stress is applied in the one-side actuating spring 24 is present at approximately the center (the lower right side of the detent fixing portion 21 in FIG. 8) of the portion in which the circular arc portion 31 is extended.

In other words, the maximum stress portion F1 which is generated when the one-side actuating spring 24 is operated is present at the side opposite to the escape wheel 2 centering on the first straight line L1. In addition, the maximum stress portion F1 is present to be the side opposite to the balance 5 by the second straight line L2 which is perpendicular to the first straight L1 line and passes through the fulcrum 23*a* of the blade 23.

In this way, in the one-side actuating spring 24, the distance from the tip of the tongue 32*c* in which the unlocking stone 4 contacts to the maximum stress portion F1 is sufficiently secured. Moreover, in the one-side actuating spring 24, the position corresponding to the maximum stress portion F1 becomes a starting point in which the elastic deformation is performed (operated). Therefore, the place being the starting point is deviated from the first straight line L1, in which the blade 23 is extended, to the side (the right side in FIG. 8) opposite to the escape wheel 2.

With reference to FIGS. 3 and 7 again, if the roller table 11 is further rotated in the direction of the arrow CW2 and reach at a predetermined angle, the unlocking stone 4 is separated from the tongue 32*c* of the one-side actuating spring 24. Then, due to the restoration force of the one-side actuating spring 24, the tongue 32*c* is displaced toward the blade 23 side (refer to an arrow Y4 in FIG. 7) and returned to the original position.

On the other hand, while the roller table 11 is rotated in the direction of the arrow CW2, the hairspring installed in the balance 5 is rewound. Then, if the hairspring is rewound by a predetermined amount, the restoration force of the hairspring and the rotation force of the balance 5 are reversed, and the rotation direction of the roller table 11 is again changed to the direction of the arrow CCW1 (a counterclockwise direction in FIG. 7).

By repeating this, the balance 5 is freely oscillated about the balance staff 9, and the detent 7 repeatedly performs the states shown in FIG. 3 and FIGS. 5 to 7. Therefore, the escape wheel 2 is always rotated at a constant speed.

(Effect)

According to the above-described first embodiment, the one-side actuating spring 24 of the detent 7 is constituted of the circular arc portion 31 and the straight line portion 32 and formed in an approximate 6-shape form in plan view, the maximum stress portion F1 generated when the one-side actuating spring 24 is operated is present to be the side opposite to the balance 5 by the second straight line L2 which is perpendicular to the first straight L1 line and passes through the fulcrum 23*a* of the blade 23. Therefore, the distance between the tip of the tongue 32*c* in which the unlocking stone 4 contacts and the maximum stress portion F1 can be sufficiently secured. Thereby, the one-side actuating spring 24 can be easily bent, and the energy loss due to the fact that the unlocking stone 4 expand the one-side actuating spring 24 can be decreased. That is, the energy loss with respect to the free oscillation of the balance 5 can be decreased. In addition, when the blade 23 is displaced toward the direction in which the blade 23 is separated from the escape wheel 2, since the straight line portion 32 of the one-side actuating spring 24 is slightly displaced only in the direction in which the circular arc portion 31 is wound, the one-side actuating spring is barely elastically deformed. Thereby, even in the above case, the energy loss with respect to the free oscillation of the balance 5 can be sufficiently decreased. Therefore, the time-keeping accuracy of the mechanical timepiece 100 can be improved.

Figure 13:
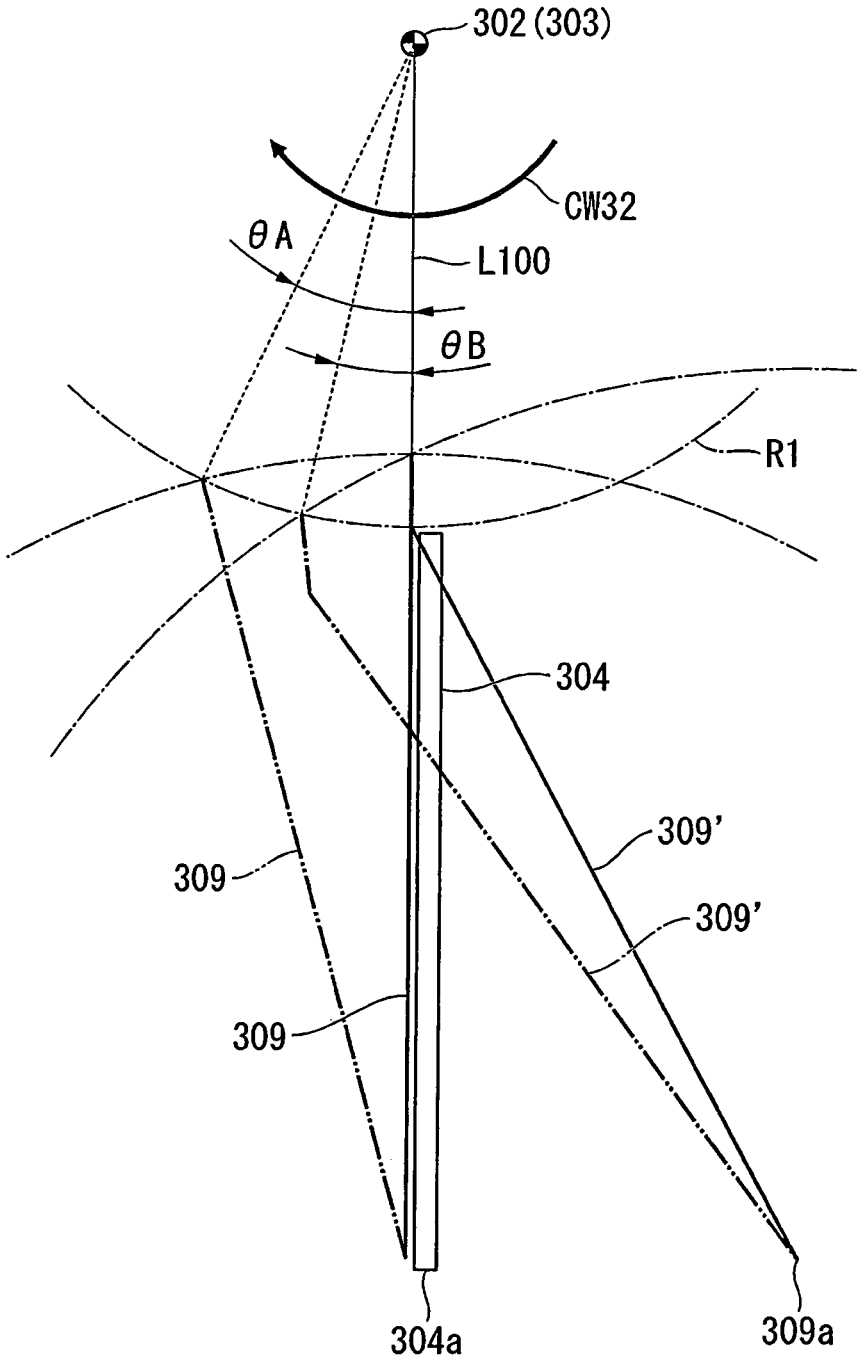
FIG. 13 is a behavior explanatory diagram of the one-side actuating spring.

In addition, the place being the starting point in which the one-side actuating spring 24 is elastically deformed is deviated from the first straight line L1, in which the blade 23 is extended, to the side (the right side in FIG. 8) opposite to the escape wheel 2. Thereby, the contact range between the one-side actuating spring 24 and the unlocking stone 4 can be set to be small compared to the related art (refer to the angle θB in FIG. 13). Therefore, the energy loss with respect to the free oscillation of the balance 5 can be more efficiently decreased.

In addition, since the circular arc portion 31 of the one-side actuating spring 24 is formed so as to enclose the periphery of the detent fixing portion 21, the distance between the tip of the tongue 32*c* and the maximum stress portion F1 can be sufficiently secured without increasing the size of the detent 7, and the place being the starting point in which the one-side actuating spring 24 is elastically deformed can be shifted from the first straight line L1. Thereby, the miniaturization of the detent 7 is improved, and the energy loss with respect to the free oscillation of the balance 5 can be reliably decreased.

In addition, since the position J1 of the center of gravity of entire detent 7 approximately coincides with the fulcrum 23*a* of the blade 23, the load which is applied to the balance spring 22 due to the inclination of the detent escapement 1 can be prevented from varying.

Moreover, since the detent fixing portion 21, the balance spring 22, the blade 23, and the one-side actuating spring 24 constituting the detent 7 are integrally molded, the number of components of the detent escapement 1 can be decreased. Thereby, the miniaturization of the detent escapement 1 is improved, and variations in the accuracy of the finished product due to the assembly errors of the detent escapement 1 can be suppressed.

In addition, the following case is described in the above-described first embodiment. That is, the one-side actuating spring 24 is constituted of the circular arc portion 31 and the straight line portion 32 and formed in an approximate 6-shape form in plan view, and the circular arc portion 31 is extended from the base end of the blade 23, that is, the base end of the arm 28. However, the invention is not limited to this. That is, at least the maximum stress portion F1 generated when the one-side actuating spring 24 is operated may be present to be the side opposite to the balance 5 by the second straight line L2 which is perpendicular to the first straight L1 line and passes through the fulcrum 23*a* of the blade 23, or the curved portion may be formed so that the curved portion is turned back toward the balance 5 side after being extended toward the side opposite to the balance 5 side in the one-side actuating spring 24.

(First Modification of First Embodiment)

(Detent)

More specifically, with reference to FIG. 9, a modification of the one-side actuating spring will be described. In addition, in the drawings hereinafter, with respect to the same aspect as the first embodiment described above, the same reference number is denoted and described (embodiments described below are similarly applied).

Figure 9:
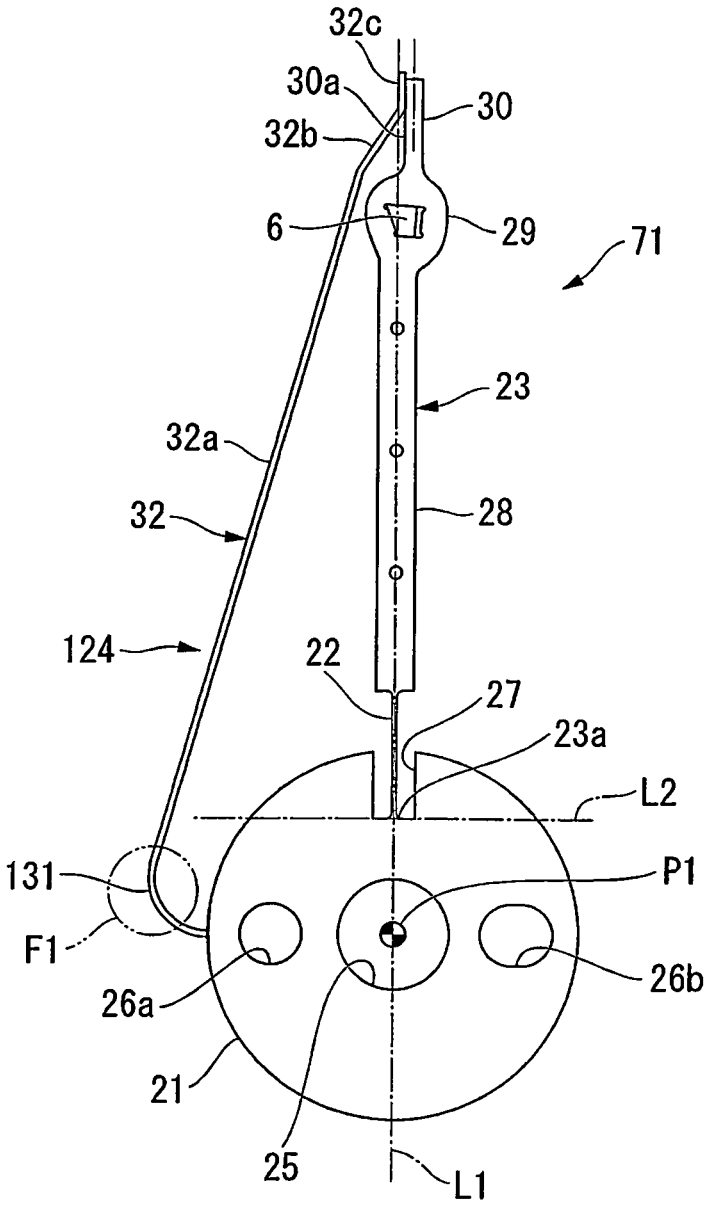
FIG. 9 is a plan view showing a detent according a first modification of the first embodiment of the invention.

FIG. 9 is a plan view showing a detent according to a first modification of the first embodiment.

As shown in FIG. 9, the one-side actuating spring 124 installed in the detent 71 of the first modification of the first embodiment includes: a curved portion 131 that is extended toward the direction approximately perpendicular to the first straight line L1 from the escape wheel 2 side (the left side in FIG. 9) of the detent fixing portion 21, and that is curved toward the tip portion 30 side of the blade 23; and a straight line portion 32 that is extended toward the tip portion 30 from the tip of the curved portion 131.

Even in the case where the one-side actuating spring 124 is formed in this way, the maximum stress portion F1 generated when the one-side actuating spring 24 is operated is present at the side (the downside in FIG. 9) opposite to the balance 5 centering on the second straight line L2. Thereby, the one-side actuating spring 124 can be easily bent compared to the related art, and the energy loss with respect to the free oscillation of the balance 5 can be decreased.

(Second Modification of First Embodiment)

(Detent)

Figure 10:
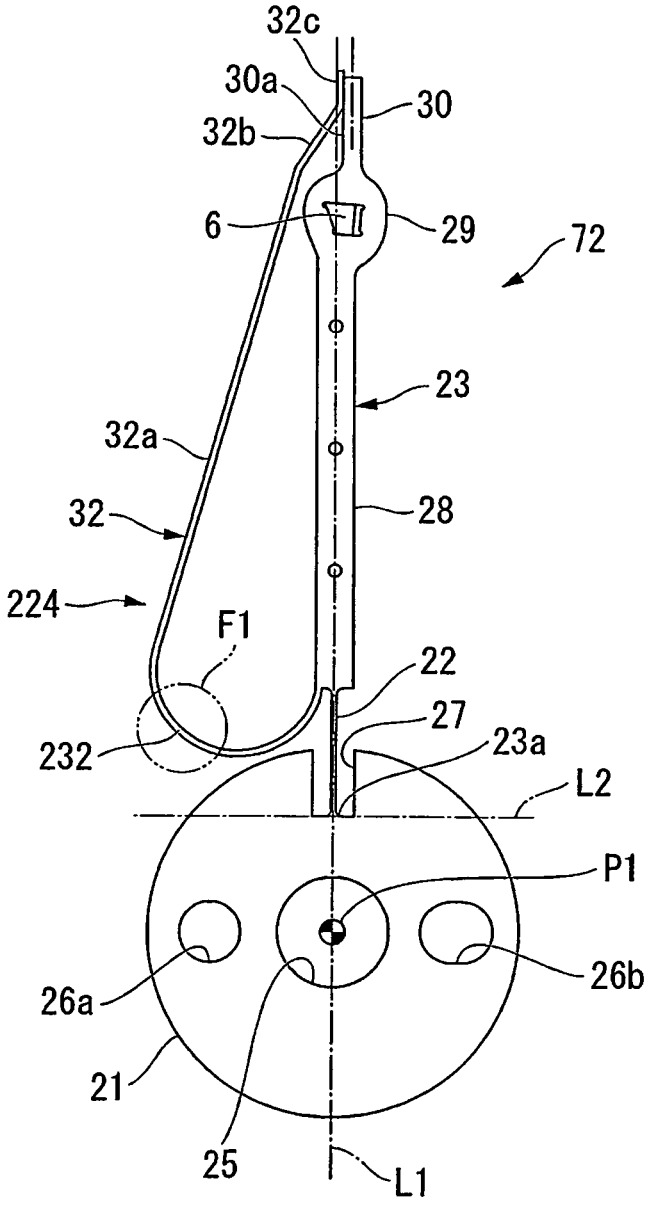
FIG. 10 is a plan view showing a detent according a second modification of the first embodiment of the invention.
Figure 11:
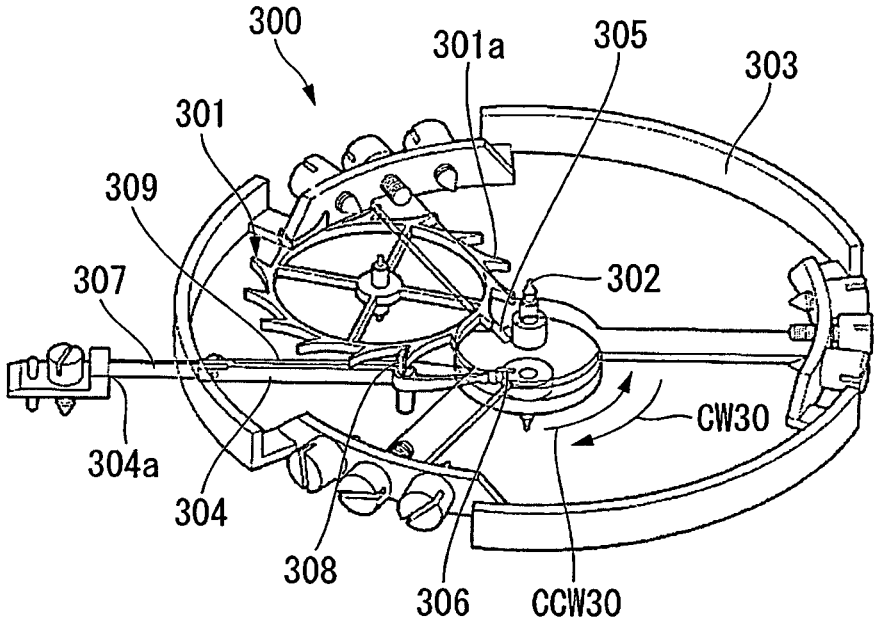
FIG. 11 is a perspective view showing an example of a spring detent escapement of the related art.
Figure 12:
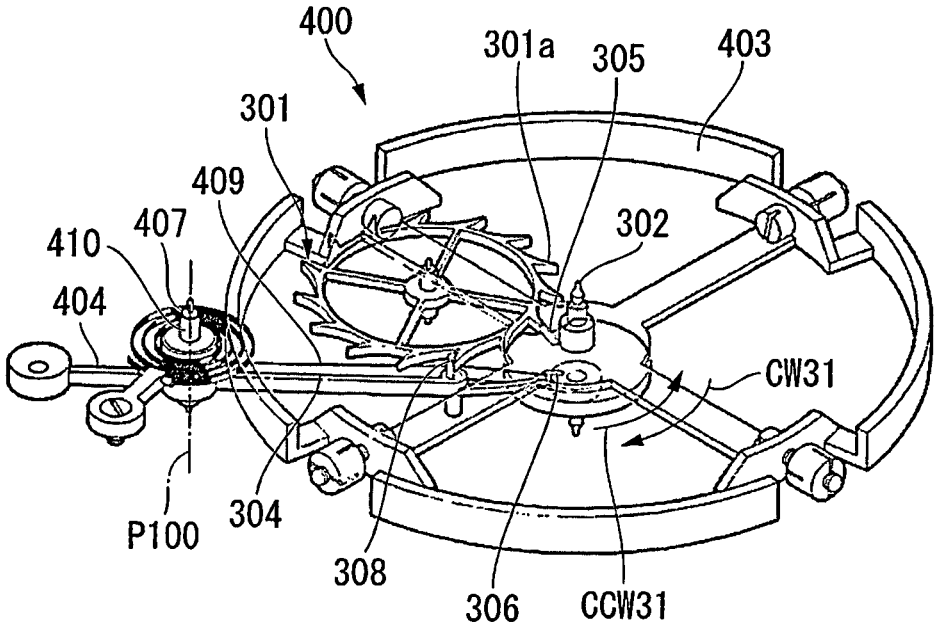
FIG. 12 is a perspective view showing an example of a pivoted detent escapement of the related art.

FIG. 10 is a plan view showing a detent according to a second modification of the first embodiment.

As shown in FIG. 10, a one-side actuating spring 224 installed in the detent 72 according to the second modification of the first embodiment includes: a curved portion 232 that is extended from the base end of the arm 28 in the blade 23; and a straight line portion 32 that is extended from the tip of the curved portion 232. After the curved portion 232 is temporarily extended toward the side (the downside in FIG. 10) opposite to the balance 5 side from the escape wheel 2 side (the left side in FIG. 10) of the arm 28, the curved portion 232 is curvedly formed so as to be turned back toward the balance 5 side. In addition, the straight line portion 32 is extended from the tip of the curved portion 232 formed as described above.

In the one-side actuating spring 224 formed in this way, the maximum stress portion F1 generated when the one-side actuating spring 224 is operated is present at the curved portion 232. That is, the maximum stress portion F1 of the one-side actuating spring 224 is present at the balance 5 side rather than the second straight line L2. However, since the curved portion 232 is formed in the one-side actuating spring 224, the one-side actuating spring 224 can be easily bent compared to the related art. Thereby, the energy loss with respect to the free oscillation of the balance 5 can be more decreased than the related art.

(Second Embodiment)

Next, a second embodiment of the invention will be described with reference to FIGS. 14A and 14B.

Figure 14B:
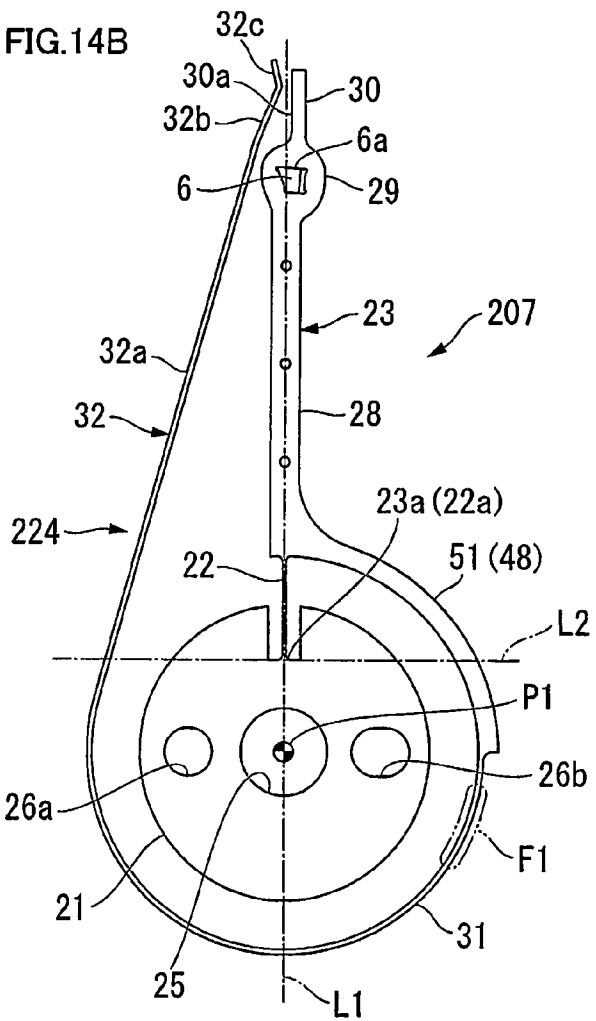
FIGS. 14A and 14B are plan views showing a detent according a second embodiment of the invention.
Figure 14A:
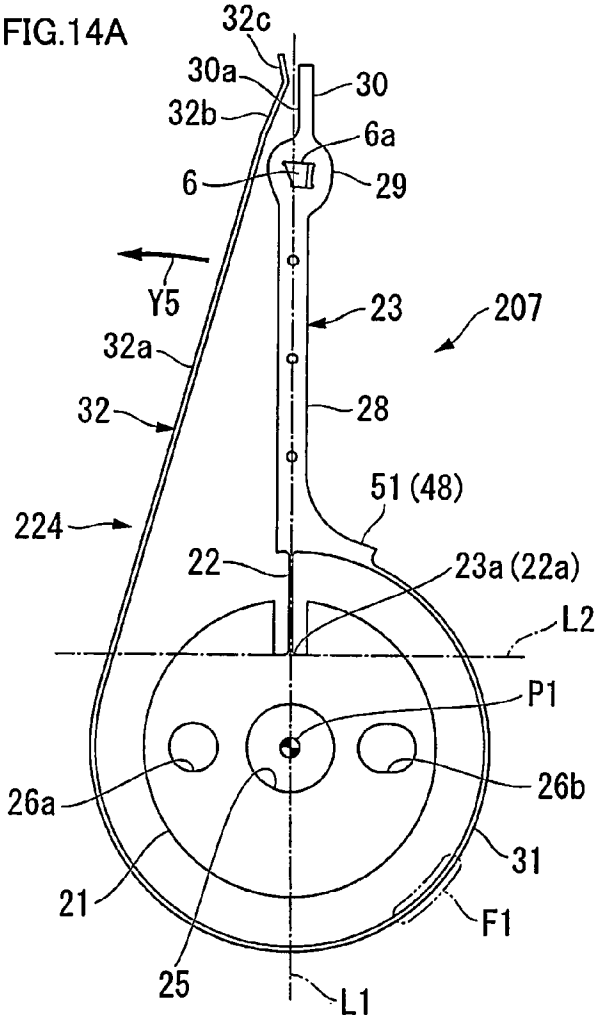

FIGS. 14A and 14B are plan views showing the detent of the second embodiment.

As shown in FIG. 14A, the difference between the second embodiment and the first embodiment is as follows. That is, in a one-side actuating spring 224 of the detent 207 of the second embodiment, a thick portion 51 is formed at the circular arc portion 31 of the one-side actuating spring 24 of the first embodiment.

That is, the thick portion 51 is extended and formed in the base end of the arm 28 constituting the blade 23 along the circular arc portion 31 of the one-side actuating spring 24. More specifically, the thick portion 51 is formed to be thicker than other portions of the circular arc portion 31. The thick portion 51 is formed in the circular arc portion 31 so as to be extended about 1/16 of the periphery of the detent fixing portion 21 from the base end of the arm 28. Thereby, when the straight line portion 32 of the one-side actuating spring 224 is expanded toward the direction (refer to an arrow Y5 in FIG. 14A) in which the straight line portion 32 is separated from the blade 23, the maximum stress portion F1 to which the greatest stress is applied in the one-side actuating spring 224 is positioned slightly more rightward and upward than the maximum stress portion F1 (refer to FIG. 8) of the one-side actuating spring 24 in the above-described first embodiment.

In this way, the thick portion 51 formed in the circular arc portion 31 functions as a maximum stress position setting portion 48 for setting the position of the maximum stress portion F1 to which the greatest stress is applied in the one-side actuating spring 224.

Here, due to the fact the length of the thick portion 51 which is extended from the arm 28 is changed, the position of the maximum stress portion F1 can be changed.

For example, as shown in FIG. 14B, when the thick portion 51 is formed in the circular arc portion 31 so as to be extended about 1/4 of the periphery of the detent fixing portion 21 from the base end of the arm 28, the position of the maximum stress portion F1 is deviated further rightward and upward than the position of the maximum stress portion F1 shown in FIG. 14A. Thereby, due to the fact that the extended length of the thick portion 51 is changed, the position of the maximum stress portion F1 can be shifted.

Therefore, according to the second embodiment, in addition to the effects similar to those of the above-described first embodiment, the maximum stress portion F1 can be set to a desired position regardless of the wiring shape of the one-side actuating spring 224. Thereby, the degree of freedom in the design of the one-side actuating spring 224 can be improved.

In addition, in the second embodiment, the case where the thick portion 51 is extended and formed from the base end of the arm 28 is described. However, the invention is not limited to this. That is, the thick portion 51 may be formed in the circular arc portion 31 of the one-side actuating spring 224.

(First Modification of Second Embodiment)

More specifically, a modification of the one-side actuating spring will be described with reference to FIG. 15.

Figure 15:
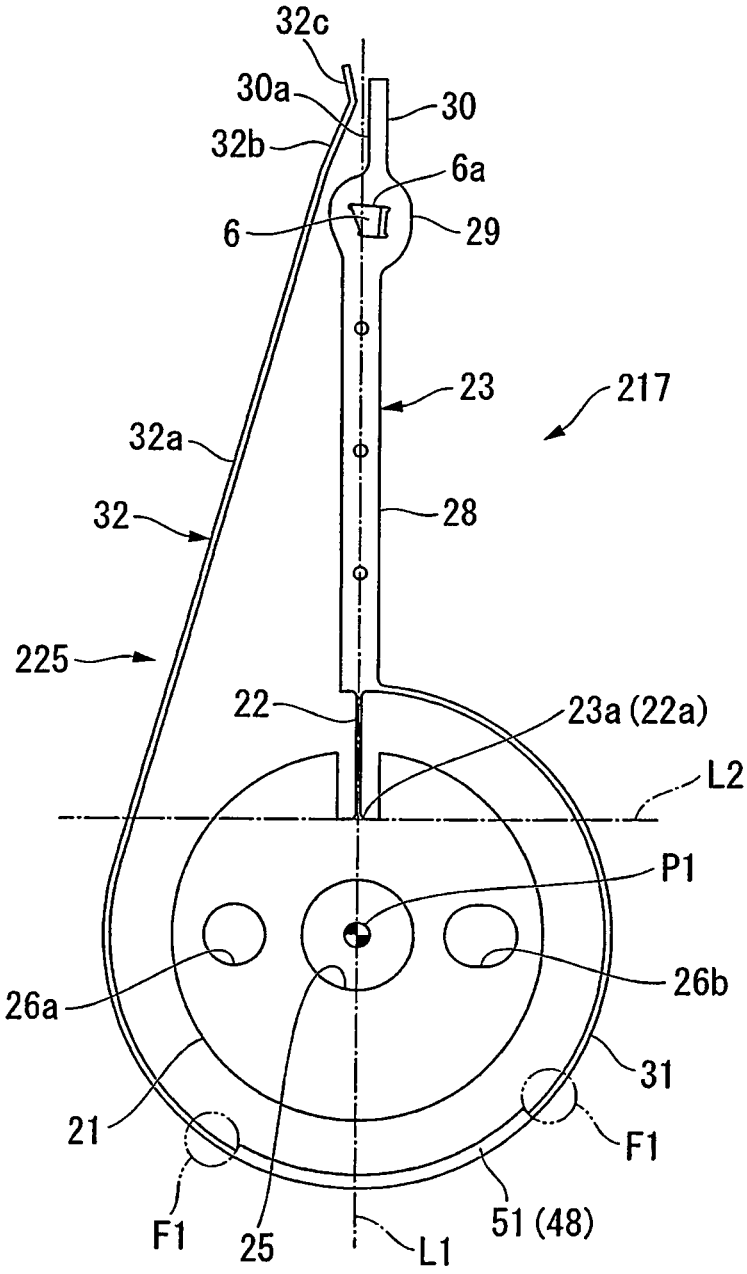
FIG. 15 is a plan view showing a detent according to a first modification of the second embodiment of the invention.

FIG. 15 is a plan view showing a detent according to a first modification of the second embodiment.

As shown in FIG. 15, in a one-side actuating spring 225 which is installed in the detent 217 according to the first modification of the second embodiment, the thick portion 51 is formed in the side opposite to the arm 28 of the center P1 of the detent fixing portion 21 in the circular arc portion 31. The thick portion 51 is extended and formed over a range of about 1/4 of the periphery of the detent fixing portion 21.

In the case where the thick portion 51 is formed in this way, the maximum stress portion F1 of the one-side actuating spring 225 is present at both ends of the longitudinal direction of the thick portion 51. That is, in the first embodiment and the second embodiment, the maximum stress portion F1 is present at one place. However, in the first modification of the second embodiment, the maximum stress portion F1 is distributed to two places. Therefore, the one-side actuating spring 225 can be more easily bent, and the maximum stress portions F1 can be distributed to two places. Therefore, damage due to the fatigue of the one-side actuating spring 225 can be prevented.

In addition, in the above-described second embodiment, the case where the thick portion 51 is formed as the maximum stress position setting portion 48 for setting the position of the maximum stress portion F1 of the one-side actuating spring 224 to a desired position is described. However, the invention is not limited to this, and any configuration which can set the maximum stress portion F1 to a desired position may be adopted.

(Second Modification of Second Embodiment)

More specifically, a modification of the one-side actuating spring will be described with reference to FIGS. 16A and 16B.

Figure 16B:
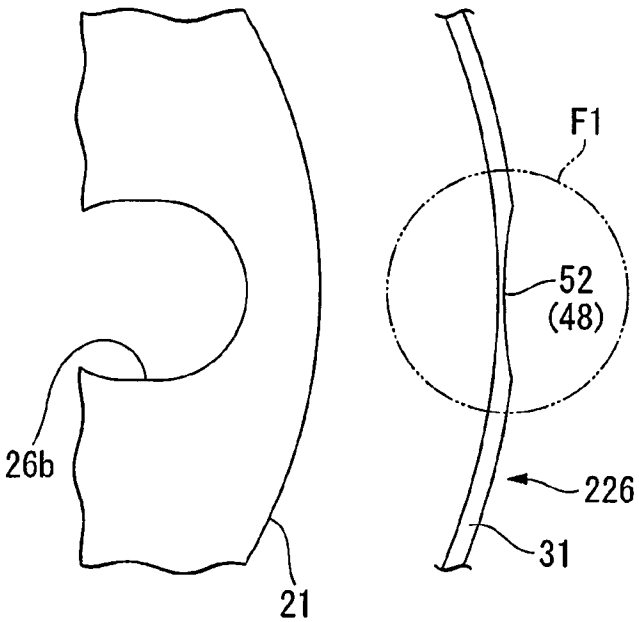
FIGS. 16A and 16B are views showing a detent according to a second modification of the second embodiment of the invention.
Figure 16A:
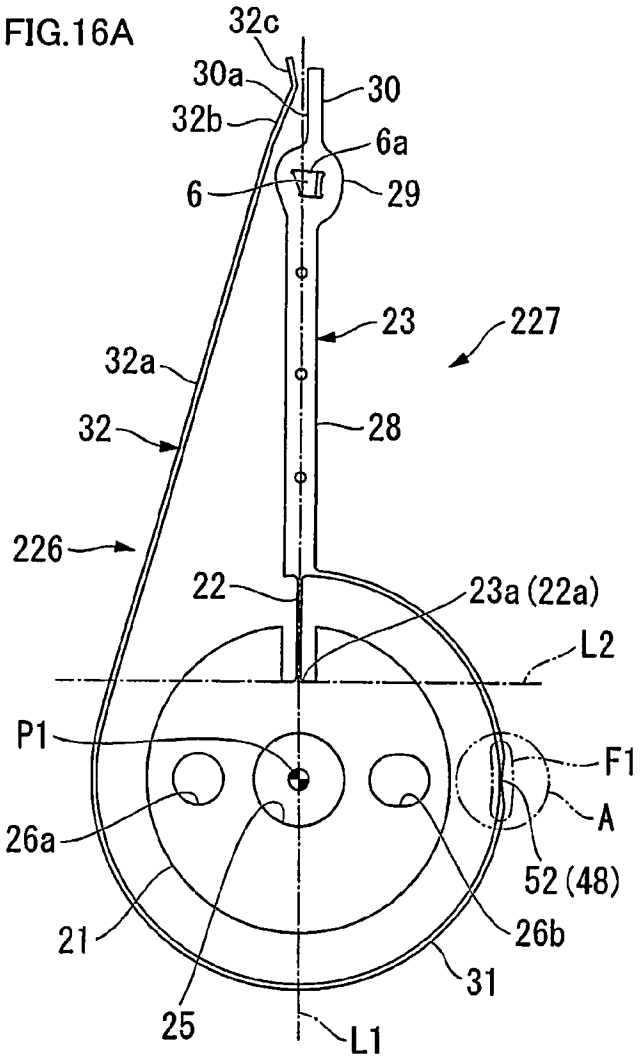

FIG. 16A is a plan view showing a detent according to a second modification of the second embodiment, and FIG. 16B is an enlarged view of an A portion of FIG. 16A.

As shown in FIGS. 16A and 16B, in a one-side actuating spring 226 installed in a detent 227 of the second modification according to the second embodiment, a thin portion 52 which is formed to be thinner than other portions is formed in the right side on the circular arc portion 31 in FIG. 16A. That is, the thin portion 52 is present at the side opposite to the escape wheel 2 centering on the first straight line L1 and at the side opposite to the balance 5 side centering on the second straight line L2.

In the circular arc portion 31 in which the thin portion 52 is formed, the strength of the place in which the thin portion 52 is formed is weaker than those of other regions of the circular arc portion 31, and stress is concentrated in the thin portion 52. That is, the place in which the thin portion 52 is formed becomes the maximum stress portion F1.

In this way, the place in which the thin portion 52 is formed can be set to the position of the maximum stress portion F1. That is, the thin portion 52 functions as the maximum stress position setting portion 48 for setting the position of the maximum stress portion F1 to which the greatest stress is applied in the one-side actuating spring 226.

(Third Embodiment)

Next, a third embodiment of the invention will be described with reference to FIGS. 17 and 18.

Figure 17:
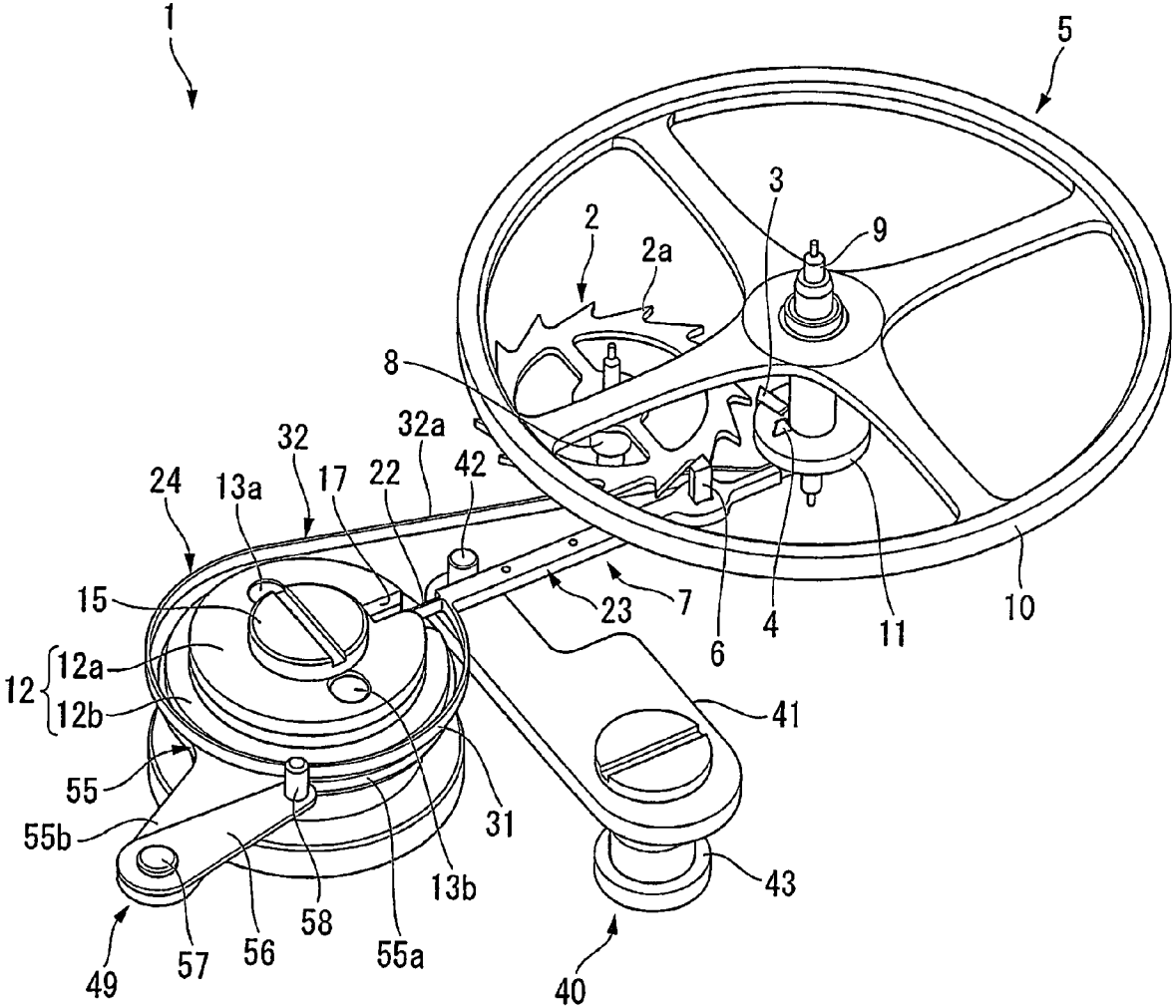
FIG. 17 is a perspective view showing a detent escapement according to a third embodiment of the invention.

FIG. 17 is a perspective view showing a detent escapement according the third embodiment of the invention.

As shown in FIG. 17, the differences between the third embodiment and the first embodiment are as follows. That is, in the detent 7 of the third embodiment, the maximum stress position setting portion 49 is installed in the fixing washer 12 for fixing the detent 7 to the main plate 102. On the other hand, in the detent 7 of the first embodiment, the maximum stress position setting portion 49 is not installed in the fixing washer 12.

Figure 18:
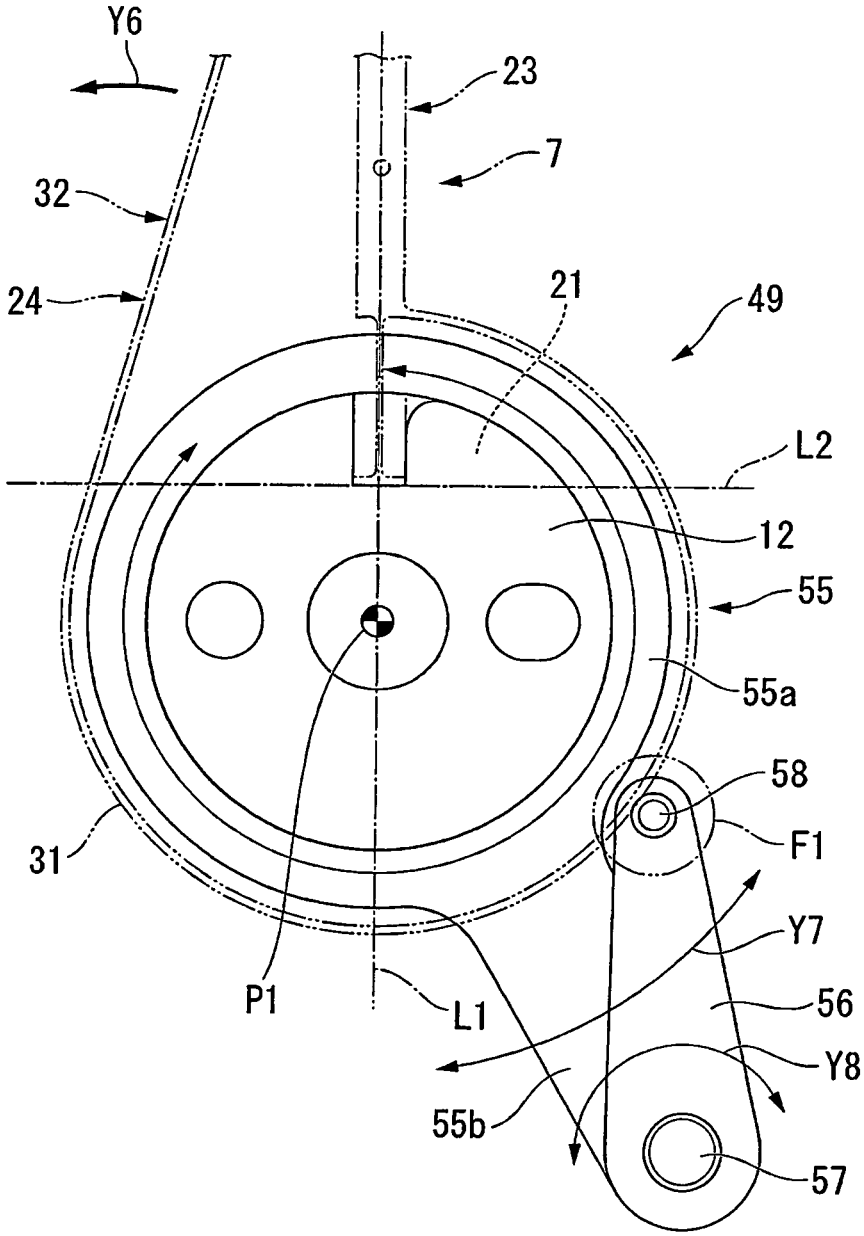
FIG. 18 is a plan view showing a maximum stress position setting portion according to the third embodiment of the invention.

FIG. 18 is a plan view showing the maximum stress position setting portion.

As shown in FIGS. 17 and 18, the maximum stress position setting portion 49 includes a supporting plate 55 which is installed slidably and rotatably with respect to the fixing washer 12. The supporting plate 55 is formed so as to be slightly greater than the outer diameter of the large-diameter washer 12*a* of the fixing washer 12. In addition, the supporting plate 55 is integrally molded by an annular portion 55*a* that is disposed coaxially with the large-diameter washer 12*a*, and a supporting arm 55*b* that is installed in the one side of the annular portion 55*a* and protruded toward the outside in the radial direction. Moreover, the supporting plate 55 is disposed so that the supporting arm 55*b* is present at approximate center (the lower right side of the fixing washer 12 in FIG. 18) of the portion in which the circular arc portion 31 of the one-side actuating spring 24 is extended.

A base end of a movable plate 56 is rotatably installed in the tip of the supporting arm 55*b* via a connection pin 57. The movable plate 56 is disposed so that the tip thereof is positioned in the vicinity of the circular arc portion 31 of the one-side actuating spring 24. In addition, a movable pin 58 is erected in the tip of the movable plate 56, and the movable pin 58 contacts the lower right side in FIG. 18 in the circular arc portion 31 of the one-side actuating spring 24. That is, the movable pin 58 is present at the side opposite to the escape wheel 2 centering on the first straight line L1 and at the side opposite to the balance 5 centering on the second straight line L2.

According to the configuration, if the straight line portion 32 of the one-side actuating spring 24 is expanded toward the direction (refer to an arrow Y6 in FIG. 18) in which the one-side actuating spring 24 is separated from the blade 23, the circular arc portion 31 of the one-side actuating spring 24 is bent with the movable pin 58, which contact the circular arc portion 31, as the fulcrum. Thereby, the place of the one-side actuating spring 24 in which the movable pin 58 contacts the one-side actuating spring becomes the maximum stress portion F1 to which the greatest stress is applied.

Here, in the maximum stress position setting portion 49, the supporting plate 55 is slidably and rotatably installed with respect to the fixing washer 12, and the base end of the movable plate 56 is rotatably installed in the supporting plate 55. Thereby, the contact position of the movable pin 58 with respect to the circular arc portion 31 of the one-side actuating spring 24 can be displaced.

That is, due to the fact that the supporting plate 55 of the maximum stress position setting portion 49 is rotated (refer to an arrow Y7 in FIG. 18) about the center P1 of the detent fixing portion 21 and the movable plate 56 is rotated (refer to an arrow Y8 in FIG. 18) about the connection pin 57, the position of the movable pin 58 can be displaced.

Therefore, according to the third embodiment, in addition to the effects similar to those of the above-described first embodiment, the maximum stress portion F1 can be set to a desired position regardless of the wiring shape of the one-side actuating spring 24. Thereby, degree of freedom in the design of the one-side actuating spring 24 can be improved.

In addition, the position of the maximum stress portion F1 can be set to a desired position without changing the shape of the one-side actuating spring 24.

Moreover, in the above-described third embodiment, the case where the movable pin 58 of the maximum stress position setting portion 49 is disposed so as to be come into contact with the circular arc portion 31 of the one-side actuating spring 24 is described. However, the invention is not limited to this. That is, when at least the straight line portion 32 of the one-side actuating spring 24 is expanded toward the direction (refer to the arrow Y6 in FIG. 18) in which the straight line portion is separated from the blade 23, the maximum stress position setting portion 49 may be disposed so that the circular arc portion 31 of the one-side actuating spring 24 and the movable pin 58 contact each other. That is, in the state where the one-side actuating spring 24 is not operated, the movable pin 58 may be disposed in the position in which the movable pin is slightly separated from the circular arc portion 31. Even in the state where the movable pin is disposed as described above, when the one-side actuating spring 24 is expanded, since the circular arc portion 31 is bent with the movable pin 58 as the fulcrum, the place in which the movable pin 58 contacts the circular arc portion becomes the maximum stress portion F1.

In addition, the invention is not limited to the above-described embodiments. That is, the invention includes those in which various modifications are added to the above-described embodiments within the scope without departing from the spirit of the invention.

For example, in the above-described embodiments, the case where the detents 7, 71, 72, 207, 217 and 227 are integrally molded by the electroforming processing or the LIGA process is described. However, the invention is not limited to this, and the detents may be molded by resin. In addition, in the embodiments, it is described to be desirable that the balance spring 22 or the one-side actuating springs 24, 124, 224, 225, and 226 are formed of an elastic material such as nickel. However, the invention is not limited to this. For example, the balance spring or the one-side actuating spring may be constituted of a leaf spring or a wire spring which are made of metal.

In addition, in the case where the detent fixing portion 21 or the blade 23 is molded by resin and the balance spring 22 or the one-side actuating spring 24 is constituted of the leaf spring or the wire spring, the balance spring 22 and the one-side actuating spring 24 may be insert-molded to the detent fixing portion 21 or the blade 23.

In addition, in the above-described embodiments, the case where the detent fixing portion 21, the balance spring 22, blade 23, and the one-side actuating spring 24, 124, 224, 225 and 226 are integrally molded is described. However, the invention is not limited to this. That is, at least the balance spring 22, the blade 23, and the one-side actuating spring 24, 124, 224, 225, and 226 may be integrally molded. Thereby, since the attachment position of the one-side actuating spring 24, 124, 224, 225, and 226 or the attachment position of the balance spring 22 is not needed to be adjusted with respect to the blade 23, variations in the accuracy of the finished product due to the assembly errors of the detent escapement 1 can be suppressed.

In addition, in the above-described embodiments, the case where the blades 23 is supported to the detent fixing portion 21 via the balance spring 22 is described. However, the invention is not limited to this. That is, as the so-called pivoted detent escapement, the blade 23 may be rotatably supported via rotation axis (not shown), and therefore, the blade 23 may approach to and separated from the escape wheel 2. In this case, a spiral spring (not shown) is installed so as to enclose the rotation axis (not shown) instead of the balance spring 22. In addition, it is desirable that the spiral spring biases the blade 23 so as to be returned to the original positions.

In addition, in the above-described embodiments, the case where the center P1 of the detent fixing portion 21, the balance spring 22, the blades 23, and the balance staff 9 all are formed at the base end 22*a* of the balance spring 22, that is, on the first straight line L1 which connects the fulcrums 23*a* of the blades 23 and the center of the balance staff 9 of the balance 5 is described. However, the invention is not limited to this. That is, the locking stone 6 of the blades 23 may approach to and separate from the wheel tooth 2*a* of the escape wheel 2.

Here, the first straight line L1 may be the line which passes through the fulcrum 23*a* of the blade 23 and the center of the balance staff 9 of the balance 5.

Moreover, in the above embodiments, the case where the cross-sectional shape of the unlocking stone 4 is formed as a trapezoid which is tapered as going toward the outside in the radial direction of the roller table 11 is described. However, the invention is not limited to this, the cross-sectional shape of the unlocking stone 4 maybe any shape such as a circular shape, an elliptical shape, or a rectangular shape if the shape of the unlocking stone 4 is the shape which can contact the one-side actuating spring 24.

What is claimed is:

1. A detent escapement for a timepiece comprising:

an escape wheel;

a balance that includes an impulse jewel which can contact a wheel tooth of the escape wheel and an unlocking stone, and that freely oscillates about a balance staff;

a blade that includes a locking stone which can contact the wheel tooth of the escape wheel, and that is supported being capable of approaching to and separating from the escape wheel; and a one-side actuating spring that can contact the unlocking stone and be elastically deformed along the approaching and separating direction with respect to the blade, wherein the one-side actuating spring is formed so that a maximum stress portion, which is generated at the time of operating due to the contact of the unlocking stone when the balance is return-rotated, is present to be the side opposite to the balance by a second straight line which is perpendicular to a first straight line which connects the center of the balance staff and fulcrum of the blade, and passes through the fulcrum.

2. The detent escapement of a timepiece according to claim 1, wherein the one-side actuating spring is fixed to the blade.

3. The detent escapement of a timepiece according to claim 1, wherein the one-side actuating spring is formed so that the maximum stress portion is present at the side opposite to the escape wheel by the blade.

4. The detent escapement of a timepiece according to any one of claims 1, wherein the one-side actuating spring comprising a curved portion, in which the one-side actuating spring is curvedly formed toward the side opposite to the balance after the one-side actuating spring is extended in the direction which intersects the extension direction from the blade, and the one-side actuating spring is curvedly formed so as to be turned back toward the balance side.

5. The detent escapement of a timepiece according to claim 4, comprising:

a balance spring that biases the blade so as to be returned to the original position; and a detent supporting portion for supporting the blade, wherein the curved portion of the one-side actuating spring is formed so to enclose the periphery of the detent supporting portion.

6. The detent escapement of a timepiece according to claim 5, wherein the one-side actuating spring is disposed so that a position of the center of gravity of a detent main body which is constituted of the blade, the one-side actuating spring, and the balance spring is positioned at the fulcrum of the blade.

7. The detent escapement of a timepiece according to claim 5, wherein the blade, the one-side actuating spring, and the balance spring are integrally molded.

8. The detent escapement of a timepiece according to claim 5, wherein the blade, the one-side actuating spring, the balance spring, and the detent supporting portion are integrally molded.

9. The detent escapement of a timepiece according to claim 4, comprising:

a maximum stress position setting portion for setting the position of the maximum stress portion generated in the one-side actuating spring to a desired position.

10. The detent escapement of a timepiece according to claim 9, wherein the maximum stress position setting portion is installed in the curved portion of the one-side actuating spring.

11. The detent escapement of a timepiece according to claim 9, wherein the maximum stress position setting portion is an adjustment member which is installed so as to be separated from the one-side actuating spring, and the adjustment member is disposed so as to come into contact with the one-side actuating spring at least when the adjustment member is displaced in the direction in which the one-side actuating spring is separated from the blade.

12. The detent escapement of a timepiece according to claim 10, wherein the maximum stress position setting portion is a thick portion which is formed in a portion of the curved portion.

13. The detent escapement of a timepiece according to claim 10, wherein the maximum stress position setting portion is a thin portion which is formed in a portion of the curved portion.

14. The detent escapement of a timepiece according to claim 11, wherein the adjustment member is a movable pin which can displace along the curved portion of the one-side actuating spring.

15. A mechanical timepiece comprising:

the detent escapement of the timepiece according to claim 1;

a mainspring that constitutes a power source; and a gear train that is rotated by the rotation force generated when the mainspring is rewound, wherein the rotation of the gear train is controlled by the detent escapement for the timepiece.

16. A detent escapement for a timepiece comprising:

an escape wheel;

a balance that includes an impulse jewel which can contact a wheel tooth of the escape wheel and an unlocking stone, and that freely oscillates about a balance staff;

a blade that includes a locking stone which can contact the wheel tooth of the escape wheel, and that is supported being capable of approaching to and separating from the escape wheel; and a one-side actuating spring that can contact the unlocking stone and be elastically deformed along the approaching and separating direction with respect to the blade, wherein the one-side actuating spring includes a curved portion, in which the one-side actuating spring is curvedly formed toward the side opposite to the balance after the one-side actuating spring is extended in the direction which intersects the extension direction from the blade, and the one-side actuating spring is curvedly formed so as to be turned back toward the balance side.

* * * * *